US007601187B2

(12) United States Patent
Webber et al.

(10) Patent No.: US 7,601,187 B2
(45) Date of Patent: Oct. 13, 2009

(54) RIGID ARM PULL DOWN EXERCISE MACHINE

(75) Inventors: Randall T. Webber, La Jolla, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 69 days.

(21) Appl. No.: 11/746,430

(22) Filed: May 9, 2007

(65) Prior Publication Data

US 2007/0232462 A1 Oct. 4, 2007

Related U.S. Application Data

(63) Continuation of application No. 10/699,995, filed on Nov. 3, 2003, now Pat. No. 7,361,125.

(51) Int. Cl.
*A63B 21/00* (2006.01)

(52) U.S. Cl. ..... 48/72; 482/96; 482/95

(58) Field of Classification Search ..... 482/72, 482/96, 57, 95, 51, 52, 112
See application file for complete search history.

(56) References Cited

U.S. PATENT DOCUMENTS

| | | | |
|---|---|---|---|
| 2,145,940 | A | 2/1939 | Marlowe |
| 4,441,708 | A | 4/1984 | Brentham |
| 4,641,833 | A | 2/1987 | Trethewey |
| 4,822,038 | A | 4/1989 | Maag |
| 4,844,456 | A | 7/1989 | Habing et al. |
| 4,949,958 | A | 8/1990 | Richey |
| 5,254,067 | A | 10/1993 | Habing et al. |
| 5,330,404 | A | 7/1994 | Lopeteguy et al. |
| 5,354,248 | A | 10/1994 | Rawls et al. |
| 5,356,358 | A | 10/1994 | Chen |
| D357,041 | S | 4/1995 | McBride et al. |
| 5,417,634 | A | 5/1995 | Habing |
| 5,478,298 | A | 12/1995 | Chen |
| 5,520,599 | A | 5/1996 | Chen |
| 5,527,243 | A | 6/1996 | Chen |
| 5,533,953 | A | 7/1996 | Lui et al. |
| D372,509 | S | 8/1996 | Yang |

(Continued)

FOREIGN PATENT DOCUMENTS

| | | |
|---|---|---|
| CA | 2075331 | 2/1994 |

*Primary Examiner*—Jerome Donnelly
(74) *Attorney, Agent, or Firm*—Procopio, Cory, Hargreaves & Savitch LLP

(57) ABSTRACT

An exercise machine for performing lat pull down exercises has a main frame having a user support pivot mount, a user support pivotally mounted on the user support pivot mount for supporting a user in a seated position, and an exercise arm having handles for gripping by a user movably mounted on the frame for movement between a start position located above the head of a user in a seated position on the user support and an end position lower than the start position and generally below the user's chin. A connecting linkage connects movement of the exercise arm to movement of the user support. A load resists movement of at least one of the moving parts of the machine. The combined motion of the user support frame and exercise arm substantially replicates the natural movement of the human body when performing a free bar chin up exercise.

35 Claims, 18 Drawing Sheets

U.S. PATENT DOCUMENTS 5,547,444 A 8/1996 Huang et al.
5,573,482 A 11/1996 Wang et al.
5,580,340 A 12/1996 Yu
5,582,563 A 12/1996 Fan
5,626,542 A * 5/1997 Dalebout et al. ..... 482/96
5,643,147 A * 7/1997 Huang ..... 482/72
5,672,142 A 9/1997 Wu
5,676,626 A 10/1997 Huang
5,683,334 A 11/1997 Webber
5,690,593 A 11/1997 Huang
5,695,434 A 12/1997 Dalebout et al.
5,720,695 A 2/1998 Eckmann
5,810,698 A 9/1998 Hullett et al.
5,897,467 A 4/1999 Habing et al.
5,899,836 A 5/1999 Chen
5,938,570 A 8/1999 Maresh
5,944,641 A 8/1999 Habing
5,961,427 A 10/1999 Habing et al.
5,971,901 A 10/1999 Shaw
6,004,247 A 12/1999 Webber
6,162,153 A 12/2000 Perez et al.
6,264,588 B1 7/2001 Ellis
6,312,366 B1 11/2001 Prusick
6,752,748 B1 6/2004 Scotti
6,811,522 B1 * 11/2004 McQuinn ..... 482/143
6,855,098 B2 2/2005 Reitz et al.
6,913,565 B2 7/2005 Mitchell et al.
6,916,278 B2 7/2005 Webber
6,971,978 B2 12/2005 Hyder
7,052,444 B2 5/2006 Webber
7,052,446 B2 * 5/2006 Morris et al. ..... 482/100
7,070,545 B2 7/2006 Lull et al.
7,108,641 B2 9/2006 Pertegaz-Esteban
7,141,003 B2 11/2006 Wu
7,141,008 B2 11/2006 Krull et al.
7,220,221 B2 5/2007 Mosimann et al.
7,223,213 B2 5/2007 Golesh
7,229,389 B2 6/2007 Hong
7,322,906 B2 1/2008 Webber
7,331,911 B2 2/2008 Webber et al.
7,335,140 B2 2/2008 Webber et al.
7,357,768 B2 4/2008 Marshall
7,361,125 B2 4/2008 Webber et al.
7,384,381 B2 6/2008 Webber et al.
7,468,024 B2 12/2008 Webber et al.
2002/0187879 A1 12/2002 Ball et al.
2003/0199362 A1 10/2003 Chamberlin
2004/0005966 A1 1/2004 Chen
2005/0032611 A1 2/2005 Webber et al.
2006/0247107 A1 11/2006 Carter
2006/0276313 A1 12/2006 Hong
2007/0293377 A1 12/2007 Webber et al.
2007/0293378 A1 12/2007 Webber et al.
2008/0058176 A1 3/2008 Webber et al.
2008/0132389 A1 6/2008 Webber et al.
2008/0153677 A1 6/2008 Webber et al.
2008/0182732 A1 7/2008 Webber et al.
2008/0214365 A1 9/2008 Webber et al.
2008/0214367 A1 9/2008 Webber et al.
2008/0220950 A1 9/2008 Webber et al.
2008/0234110 A1 9/2008 Webber et al.
2008/0242517 A1 10/2008 Webber et al.
2008/0248929 A1 10/2008 Webber et al.

* cited by examiner

RIGID ARM PULL DOWN EXERCISE MACHINE

RELATED APPLICATION

This application is a continuation of U.S. patent application Ser. No. 10/699,995 of concurrent ownership, filed on Nov. 3, 2003, now U.S. Pat. No. 7,361,125, the contents of which are incorporated herein by reference.

BACKGROUND

1. Field of the Invention

The present invention relates generally to exercise machines, and is particularly concerned with a rigid arm pull down exercise machine for performing chin up and pull up type exercises.

2. Related Art

A free chin up or pull up exercise involves an overhead bar which the user grips with their hands and then pulls in order to raise or lower their body. This is an exercise which is difficult for many people to perform, and requires balance, coordination and strength for an exerciser to raise and lower their body while suspended by their hands. The exercise involves a multi-joint movement involving muscles in the upper and lower back as well as the biceps and forearm. Improper form by the exerciser, such as swinging, kicking the legs, arcing backwards or not tucking the head, can make the exercise more difficult, increase stress to the joints, or lead to injury.

The counter-balanced or assisted chin-up machine was developed in order to enable less conditioned exercisers to perform this basic exercise movement, and also in order to provide a safer chin up or pull up exercise. Some examples of machines for performing chin up/pull up exercises are U.S. Pat. No. 3,592,465 of Fulkerson, U.S. Pat. No. 3,707,285 of Martin, U.S. Pat. No. 4,111,414 of Roberts, U.S. Pat. No. 5,011,139 of Towley, U.S. Pat. No. 5,322,489 of Webb, U.S. Pat. No. 5,449,959 of Homes, and U.S. Pat. No. 5,540,639 of Potts. These machines use various types of load or resistance to counter-balance the user's body weight and assist them in performing the exercise. In order to perform an exercise, the user stands or kneels on the user support, engages the handles, and then pulls with their arms in order to raise their body, assisted by the counter-balanced user support. Fulkerson, Martin, Holmes, and Potts use a linear, vertical movement, requiring the user's head to pass the handles in order to complete the exercise movement. In order to avoid the user's head from striking the handle bar in completing this movement, Holmes and Potts provide separate right and left handles so that the user's head can pass between the handles. In Fulkerson and Martin, the user must move their head to avoid the straight, single piece chin bar, which is both awkward and dangerous. Additionally, these designs do not duplicate the natural arcuate motion of a free bar chin up exercise.

Webb has a user support platform for supporting a user in a kneeling position, and does provide a more natural, arcuate movement path, so that the user's head will pass in front of the gripping means. However, because of this movement, Webb cannot provide a neutral grip position. The arcing away from, and then back towards, the vertical centerline of the handles requires the hand/wrist position to change and track with the user position. A fixed, neutral position would cause strain on the wrists, causing them to bend at an unnatural angle. In Towley, the user support arcs towards the user engaging handles throughout the entire arcuate path, avoiding this problem. However, separate handles must be provided to avoid the user's head from making contact with the handle bar. In each of the above known designs, although the user support moves, it is not urged to do so by movement of an exercise arm. The only user engagement means are a handle bar or handles which are stationary and fixed in relation to the exercise machine main frame throughout the exercise. The amount of exercise resistance felt by the user can never be greater than the user's body weight, which may not provide enough resistance for advanced users. These machines are also quite large and awkward to use, as the exerciser must climb up steps to mount the machines and must blindly try to find the steps when stepping backwards off the machine. The machines are also relatively complex and expensive to manufacture.

U.S. Pat. No. 3,640,528 of Proctor is an example of a traditional cable lat pull down machine. It has a weight stack mounted for vertical displacement on a main frame, a stationary user support on the frame, and an overhead user engaging bar connected to the weight stack via cables and pulleys. In order to perform the exercise, the user grips the exercise bar while seated on the seat, and pulls the bar down to his or her chin. Because it is a single piece bar, the user must take care to avoid hitting their head with the bar as they pull it downwards, since it is attached to a free-swinging cable. The user must therefore be careful to apply an even force with each arm and to pull the bar in the correct exercise path in order to avoid possible injury.

In order to avoid the safety concerns of a free cable lat pull down, the rigid arm lat pull down exercise machine was developed. This exercise machine consists of a main frame, a stationary user support fixed to the main frame, an exercise arm or arms pivotally mounted on the main frame, and a resistive load associated with movement of the exercise arm. U.S. Pat. No. 5,050,873 of Jones, U.S. Pat. No. 5,562,577 of Nichols Sr., and U.S. Pat. No. 5,810,701 of Ellis are examples of rigid arm pull down exercise machines. These machines have exercise arms providing a converging exercise motion, traveling inward towards one another during their exercise path. Jones and Nichols have dual exercise arms for independent exercise movement while the exercise arms of Ellis are dependent. Jones, Nichols, and Ellis all provide weight receiving means or pegs for adding weight plates to vary the exercise resistance.

U.S. Pat. No. 5,263,914 of Simonson and U.S. Pat. No. 6,074,328 of Johnson show lat pull down machines that utilize a sliding, adjustable load to vary the resistance to the exercise arm. U.S. Pat. No. 5,749,813 of Domzalski shows a selectorized lat pull down machine which has an exercise arm assembly with user engaging means mounted to a first end and a pivotal connecting linkage attached to its second end. The load is connected to the exercise arm via the pivotal connecting linkage.

U.S. Pat. Nos. 5,447,480 and 5,549,530 of Fulks both describe multi-exercise machines which include a back supported lat pull down exercise. In both cases, the exercise arm is pivotally mounted on the main frame for bidirectional movement. In the first patent, a user support carriage is slidably mounted on the base of the frame to provide fixed adjustment points for the user support relative to the exercise arm. Other rigid arm lat pull down machines with a fixed user support are described in U.S. Pat. Nos. 5,437,589 and 5,967,954 of Habing, U.S. Pat. No. 5,597,375 of Simonson, U.S. Pat. No. 6,071,216 of Gianelli, and U.S. Pat. No. 6,394,937 of Voris.

These prior art lat pull down exercise machines are all subject to various disadvantages. In some cases, the user has to adjust their body position or tuck in their head to miss a single bar user engaging means, as in Fulkerson, Martin, and Proctor. Some of the machines are not easily accessible, particularly those with moving user support platforms such as Fulkerson, Martin, Towley, Webb, Holmes and Potts. These machines in general do not provide all the possible hand grip starting positions for different types of chin up/pull up exercises, and do not provide proper starting and finishing arm/hand positions. In the machines with pivoting exercise arms which travel in an arc, the arc motion is generally greater than that of the natural, free bar exercise motion, producing an exaggerated and unnatural exercise movement.

SUMMARY

The present invention provides a system and method for It is an object of the present invention to provide a new and improved rigid arm lat pull down exercise machine.

According to one aspect of the present invention, a rigid arm lat pull down exercise machine is provided, which comprises a main frame having a user support pivot mount, a user support frame pivotally mounted on the user support pivot mount for supporting a user in a seated position, a user engagement means movably mounted on the frame for movement between a start position located above the head of a user in a seated position on the user support frame and an end position lower than the start position and generally below the user's chin, a connecting linkage connecting movement of the user engagement means to movement of the user support frame, and a load for resisting movement of at least one of the moving parts of the machine, the combined motion of the user support frame and user engagement means between the start and end position substantially replicating the natural movement of the human body when performing a free bar chin up exercise.

Unlike all known prior art rigid arm lat pull down machines, the machine of this invention provides a combined motion of the user support frame and user engagement means which replicates the natural, gradual rearward arcing movement of the upper part of the human body in performing free bar chin up exercises. By pivoting the user support and adjusting the position of the user relative to the position of the user engagement means during the exercise movement, a slight arcing motion is provided, which is a more accurate simulation of the corresponding natural body movement in a free bar exercise. Because the movement of the user support is linked to movement of the user engagement means or exercise arm, the self-alignment is automatic and continuous throughout the entire exercise range of motion.

The user support frame may have a seat pad and a thigh hold-down pad or belt both mounted in a fixed relative position on the support frame. A foot rest may also be mounted on the moving user support frame, or may alternatively be provided on the main frame. The user support frame may also have a back pad.

The user support pivot mount is provided directly under the user support frame. The user support frame is arranged to start in a slightly rearwardly reclined position and to rotate upwardly from that position in an arc into an upright or slightly forwardly inclined position at the end of the exercise movement. This slight rocking motion provides for a comfortable and more enjoyable exercise. The pivot mount defines a vertical gravitational center line and is positioned such that a balanced portion of the weight of the user and user support frame is positioned on each side of the gravitational center line throughout the exercise motion, so that the user's body weight has little effect on the resistance. This helps reduce the initial lift or starting resistance, and to avoid substantial resistance "drop-off" at the end of the exercise.

The relative positions of the user support frame and user engaging means are such that the user is placed with their arms extending straight overhead, in line with the side center line of their body, in the starting position, and ends with their hands below their chin and slightly in front of their shoulders in the end position. These are exactly the same start and end positions as are found in a free bar chin up or pull up exercise.

The exercise arm may be pivoted to the main frame in a position spaced forwardly or rearwardly of the user support. The starting position places the user's upper body in a slightly forward lean to compensate for the reclined angle of the seat. As the exercise arm moves downward, the user support frame pivots, bringing the seat section upward and changing its orientation from a reclined angle to an upright, horizontal position or an inclined angle. The user will automatically adjust their upper body position rearward to compensate for this change in seat angle, mimicking the natural rearward arc of a person's body when performing a free bar chin up exercise. This very slight body position adjustment involves pivoting at the waist, similar to a child riding on a seesaw, and will be practically unnoticed by the exerciser because they are in a stable, braced position with their thighs held down.

The user engagement device or exercise arm may be made in one piece for dependent arm and hand movement, or may be made in two pieces for independent left and right arm movement, and may provide for unidirectional or bidirectional movement. The connecting link or linkage may be one part or multiple parts, may be adjustable in length, and may be a rigid link, a flexible pulley and cable linkage, a sliding linkage, a gear linkage, a rotating cam linkage, or the like. The exercise arm may be pivoted to an upright portion of the main frame, either in front of the user support frame in an overhead position, or behind the user support frame, or may be slidably mounted on the main frame. The load may be linked to the user support frame, the exercise arm, or the connecting link. Any suitable exercise resistance may provide the load, such as a selectorized weight stack, peg-mounted weight plates, or other types of exercise resistance such as hydraulic, pneumatic, electromagnetic, elastic bands, or the like.

In this machine, the seat and secondary support travel together to keep the user in the same basic position (apart from the slight adjustment in upper body orientation) during the exercise movement. The low-to-the ground seated position makes the machine quicker, safer, and easier to enter and exit than some prior art machines with moving platforms. The machine is significantly less complex than some prior art machines, and has a relatively low profile, making it less intimidating to users and also less expensive to manufacture. The rocking motion of the user support makes the exercise more fun to perform. Repetitious exercise movement can be tedious and boring. By adding motion to the user support, performing the exercise is more enjoyable and the user's interest in their workout will increase. In most cases this will lead to the user exercising more regularly.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for systems an exercise machine for performing chin up and pull up exercises.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

FIGS. 1 to 6 illustrate a rigid arm lat pull down exercise machine 10 according to a first embodiment of the present invention, which allows a user to perform a chin up type exercise similar to a free bar, free body weight chin up or pull up exercise. The exercise carried out by this machine will accurately mimic the natural, slightly rearward arcing movement of a user's body from the start to the finish position of an equivalent free bar exercise.

Figure 2:
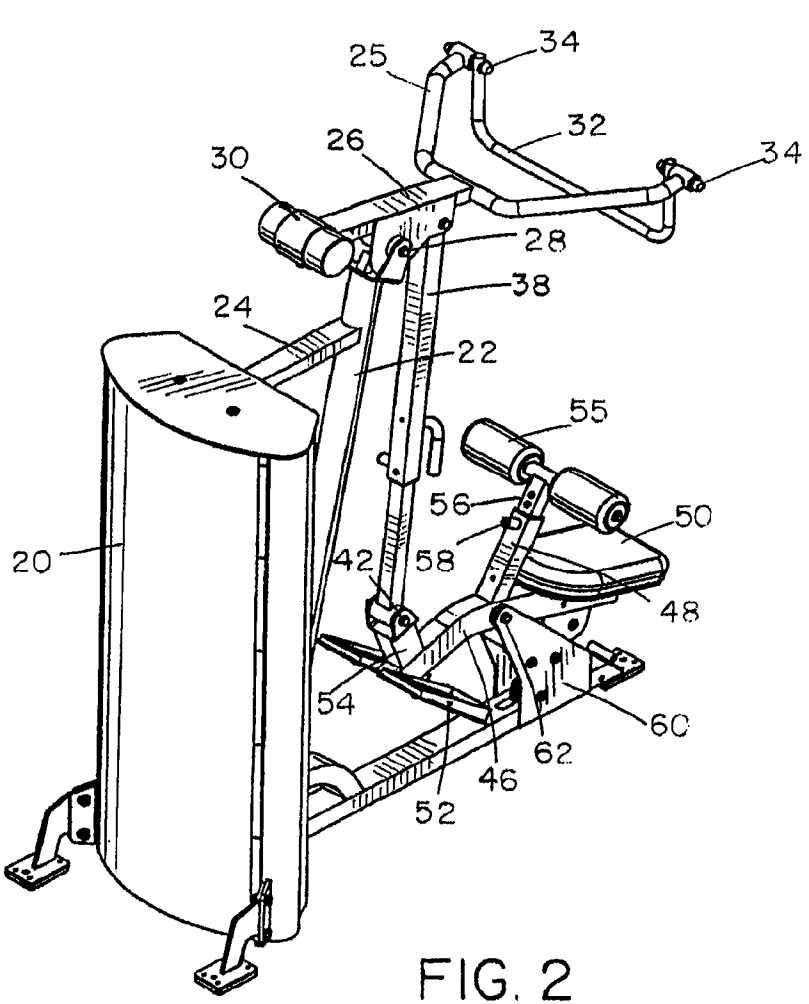
FIG. 2 is a front perspective view of the machine of FIG. 1.
Figure 1:
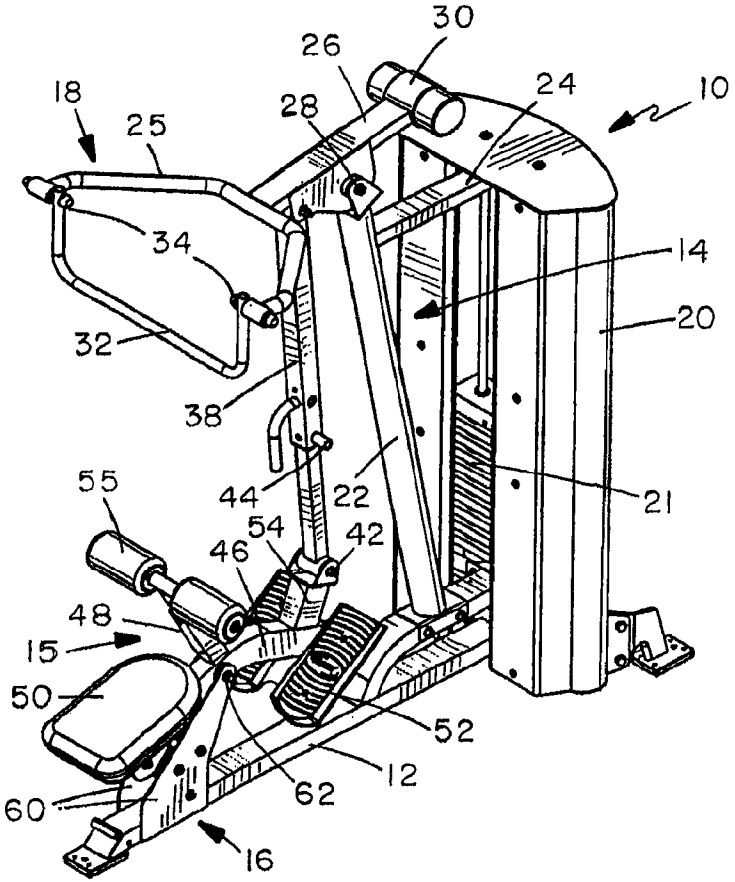
FIG. 1 is a rear perspective view of a rigid arm lat pull down exercise machine according to a first embodiment of the invention.

The machine 10 comprises a main frame having a horizontal base section 12 and an upright section 14, a generally T-shaped user support frame 15 pivotally mounted on the base section via pivot mount 16, and an exercise arm 18 pivotally mounted at the top of the upright section 14 of the frame above the user support. FIG. 1 is a rear perspective view of the machine, i.e. a view towards a user's back when seated on the user support, while FIG. 2 is a front perspective, in a direction which would face a seated user. The upright section 14 of the frame includes a vertical housing 20 containing a weight stack 21, and a slightly rearwardly inclined upright strut 22. A horizontal strut 24 extends between the top of housing 20 and the upright strut 22.

The exercise arm 18 comprises a generally U-shaped member 25 with an elongate member 26 extending from the midpoint of the U-shaped member towards the weight stack and pivoted to the upper end of strut 22 via pivot 28 at a mid point in its length. A counterweight 30 is mounted at the end of member 26. A U-shaped handle bar 32 is pivoted at pivots 34 to the ends of the U-shaped member 25 so as to be suspended downwardly from bar 25 for gripping by a user.

A linkage comprising an adjustable length connecting link 38 pivotally connects the exercise arm 18 to the user support frame 15. The link 38 has a first end pivoted to the elongate member 26 of the exercise arm at pivot 40, and a second end pivoted to the user support frame 15 at pivot 42. The link 38 comprises two telescopically engaging parts which are secured together at a selected extension via a spring loaded pull pin 44 engaging in a selected opening 45 in one of the telescoping parts.

The user support frame 15 is generally T-shaped, having a base member 46 and an upright member 48 projecting upwardly from the central region of member 46. A seat pad or primary support 50 is mounted at the rear end of base member 46, facing upright member 48, and a foot rest or stabilization means 52 is mounted at the forward end of member 46. The connecting link pivot 42 is provided on a pivot mount 54 adjacent foot rest 52. A secondary user support for holding down the user's thighs is provided at the upper end of upright member 48, and comprises a pair of roller pads 55 on a strut 56 telescopically mounted in member 48. The position of the roller pads 55 can be adjusted by moving strut 56 up or down and then securing it in position via a spring loaded pull pin 58.

The user support frame 15 is pivotally mounted on the base section 12 of the main frame via a pair of pivot mounting plates or brackets 60 secured to the base section 12 and having upper ends pivoted to the base member 46 of the user support frame via pivot pin 62. The rear end of the base member 46 is linked to the weight stack via a cable and pulley assembly, only part of which is visible in the drawings. Cable 64 extends over pulleys mounted between mounting plates 65 secured beneath base member 46 and over pulleys mounted between pivot mounting brackets 60, and then runs through the base section 12 of the frame and into the weight stack housing, where it extends over further pulleys (not visible in the drawings) before linking with the weight stack in a conventional manner.

Figure 3:
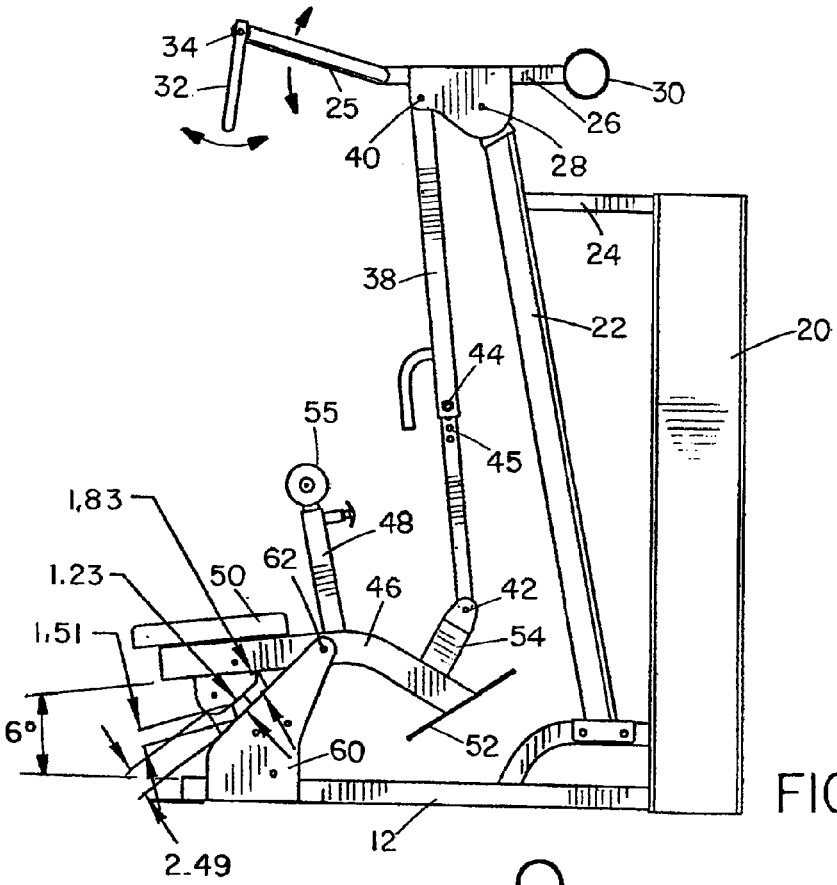
FIG. 3 is a side elevation view of the machine of FIGS. 1 and 2, illustrating the start position of the exercise arm and user support frame.
Figure 4:
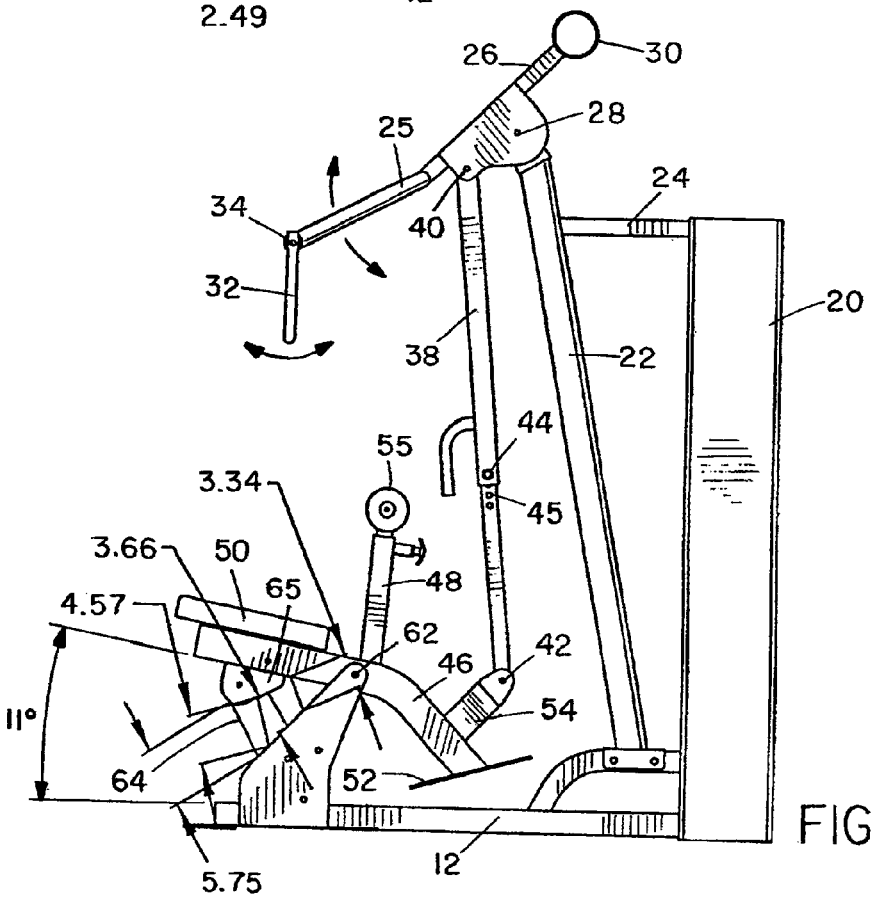
FIG. 4 is a side elevation view similar to FIG. 3, illustrating the exercise finish position of the moving parts of the machine.
Figure 6:
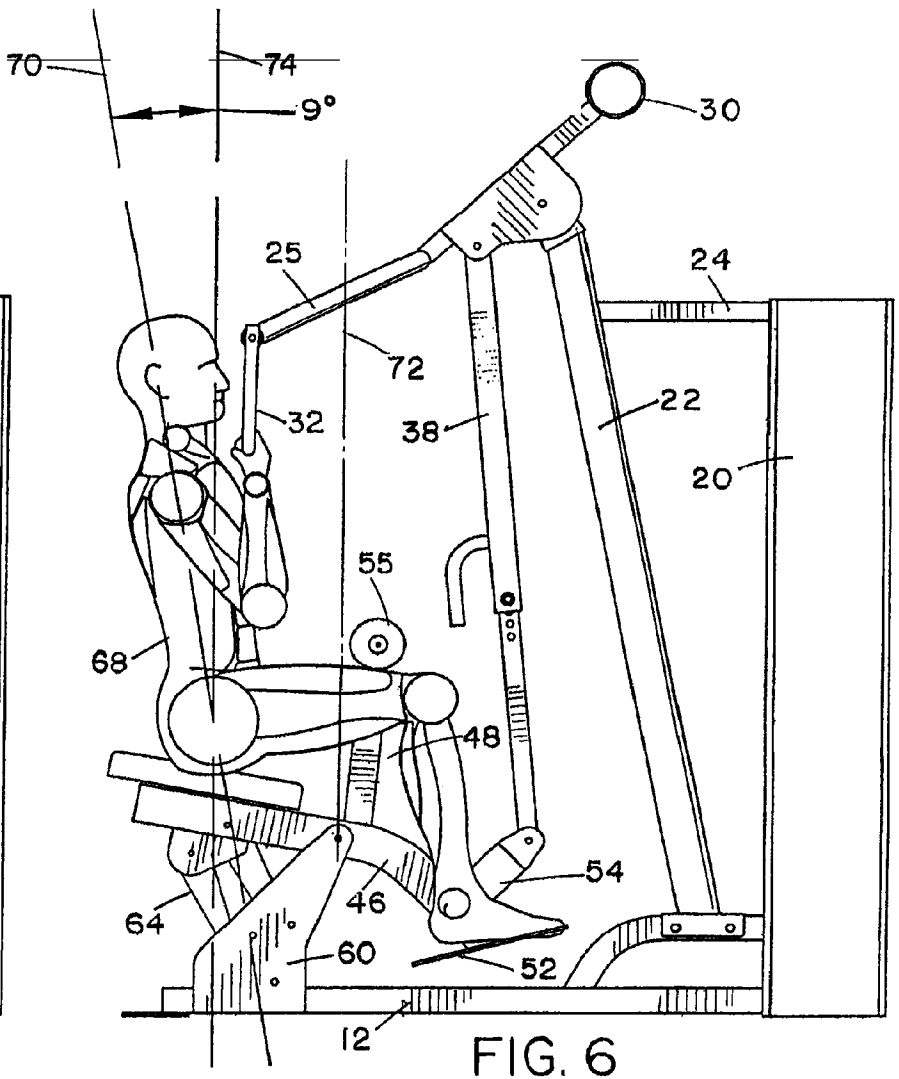
FIG. 6 is a side elevation view similar to FIG. 5, but illustrating the machine and user position at the end of an exercise movement.
Figure 5:
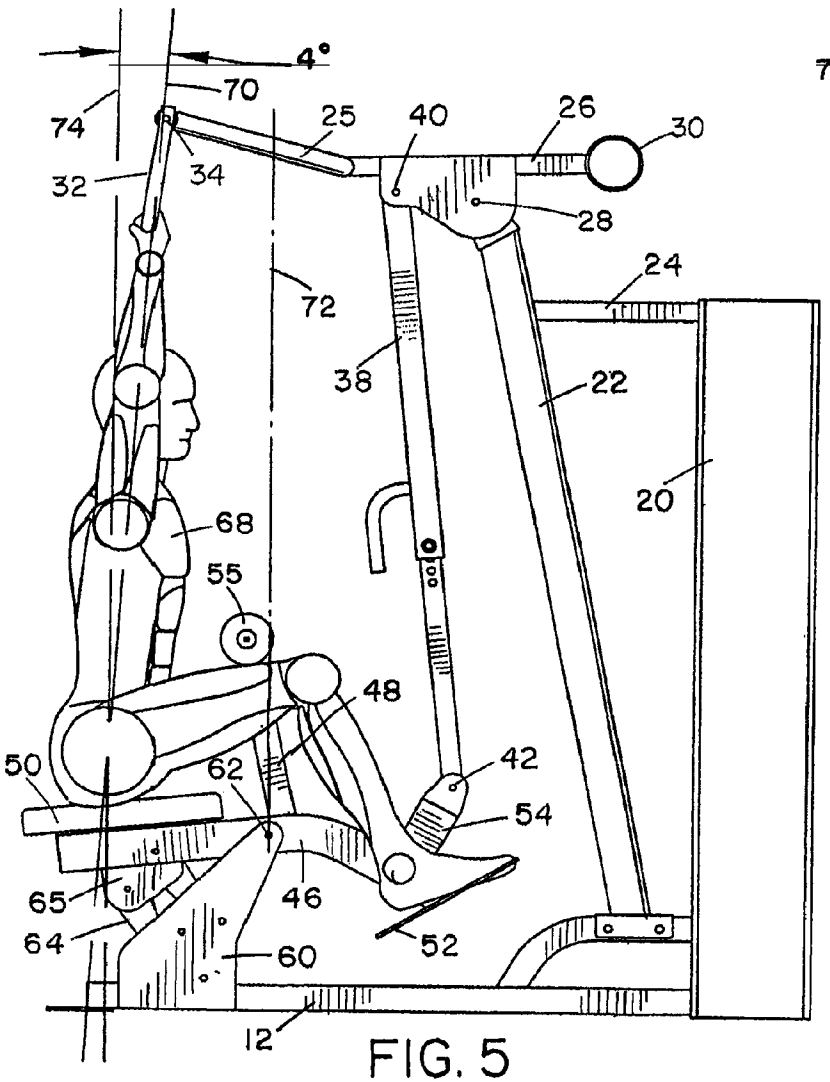
FIG. 5 is a side elevation view similar to FIG. 3, but on an enlarged scale, and illustrating a user seated on the user support in the exercise start position.

FIGS. 1 and 3 illustrate the start position of the rigid arm pull down machine without an exerciser, while FIGS. 2 and 4 illustrate the finish position. FIGS. 5 and 6 illustrate the same positions with the user 68 in place to perform a chin up exercise. To perform the exercise, the user positions themself in a seated position on seat pad 50, which will start in a slightly downwardly reclined orientation as illustrated in FIG. 3, with the exercise arm in an elevated position. The counterweight 30 acts to offset the weight of the exercise arm and keep it in the elevated position prior to use of the machine. The user will slide their legs under the thigh hold down roller pads 55, adjusting the position of these pads by sliding the strut 56 up and down if necessary, and place their feet on the user support footrest or plate 52. They then grab the handle bar 32 of the exercise arm 18 with their arms extending straight above their head, as in FIG. 5, and pull it downwards. The starting position of FIG. 5 places the user's upper body in a slightly forward lean with their arms extending straight overhead, in line with the side center line 70 of their body. If necessary, the user can adjust the distance between the user support seat 50 and exercise arm bar or handle 32 by adjusting the length of connecting link 38.

As the exercise arm 18 moves downwards, rotating about the pivots 28 and 40, the connecting link 38 pushes the rear end of the user support frame 15 downwards, rotating the frame about the pivot 62 into the finish position illustrated in FIGS. 2, 4 and 6, in which the seat pad 50 is rotated forwards into an upwardly inclined orientation. At the same time, the selected weights in the weight stack are lifted via the cable and pulley linkage between the user support frame and the weight stack. As the seat pad changes its orientation from a reclined angle to an inclined angle, the user will automatically adjust their upper body position rearward (relative to their angular position on the seat) to compensate for this change in seat angle, and will finish the exercise with their hands below their chin and slightly in front of their shoulders, as illustrated in FIG. 6. This slight rearward movement mimics the natural rearward arc a person's upper body goes through when performing a free bar chin up exercise. This exercise motion closely mimics the natural body alignment of an exerciser in both the start and finish positions when performing body weight exercises on a chinning bar. This provides the user with a safer and more comfortable compound exercise movement than was possible with previous rigid arm pull down exercise machines.

It can be seen that the user support pivot 62 is positioned under the user support frame such that a substantial portion of the combined weight of the user and the support frame is positioned on each side of the gravitational center line 72 of the pivot in both the start and finish position. The portion of both the user and the user support positioned on each side of line 72 varies only very slightly from the start to the finish point of the exercise movement. This balanced distribution minimizes the effect that the combined weight of the user and user support has on the exercise resistance, while still allowing it to act as a counter balance to offset the weight of the exercise arm. The combined weight of the user and support will have little effect on the amount of starting resistance, because a substantially equal amount of weight is balanced rearward of the user support pivot. By the same token, because only a small portion of the user passes through the gravitational center line 72 during the exercise, there is no appreciable drop off in resistance felt by the user.

The line 74 in FIGS. 3 and 4 represents the perpendicular or vertical centerline of the user in both the start and finish positions, while line 72 is the side centerline. As illustrated in FIG. 3, at the start of the exercise, the user is in a forward lean of approximately 4 degrees off vertical, with their arms fully extended and in line with the body side centerline. At the end of the exercise, as illustrated in FIG. 6, the user is reclining at approximately 9 degrees to the vertical centerline 74, with their hands positioned under the chin and slightly forward of their shoulders. Thus, the upper body moves through an angle of approximately 13 degrees, as it will when performing a free chin up exercise with an overhead chinning bar. Because the user is securely positioned on the traveling user support, only a small adjustment at the hip is needed to duplicate the natural upper body movement and positioning of a free bar chin up exercise. The amount of upper body movement, which depends on the combined travel of the exercise arm and user support, will vary with different size users. The pull down exercise machine 10 therefore closely mimics the natural movement and body alignment found in a free bar chin up exercise.

As can be seen by comparison of the user and user support frame positions of FIGS. 5 and 6, the portion of the user and user support positioned on each side of the gravitational center line 72 of the pivot changes only slightly from the start to the finish of the exercise. The center line 72 runs just forward of the thigh hold down pads 55 in the start position of FIG. 5, and ends just rear of the thigh hold down pads in the finish position of FIG. 6. Because so little of the user passes through the center line 72 during the exercise, there is no appreciable drop off of resistance felt by the user. The combined weight of the user and user support frame also has little effect on the amount of starting resistance, because a substantially equal amount of the weight is balanced rearward of the user support pivot.

FIGS. 3 and 4 illustrate the amount of cable pull, which determines the resistance felt by the user, when measured against the amount of exercise arm travel. The cable pull in this case is approximately 10.16 inches, based on subtracting the added total of cable length shown in the starting position of FIG. 3 (1.83+1.23+1.51+2.49=7.06) from the total length in the finishing position (17.22). FIGS. 3 and 4 also illustrate the angular travel of the user support from the start position to the end position. As illustrated, the user support travels through an angle of 5 degrees from the start to the end position. The travel arc of the exercise arm 18 and the pivotal arc of the user handle are also illustrated in both FIG. 3 and FIG. 4, illustrating the self-aligning capability of the handle throughout the exercise movement, so that the user is not forced to change their hand and wrist orientation. This can also be seen in FIGS. 5 and 6.

Another advantage of this machine is the multiple user supports for added security and stability of the user while performing the exercise. The primary user support in this case is the seat pad 50, while a secondary support is provided by the thigh hold-down pads 55. A further support or stabilization means is provided by the foot pads 52 which travel with the user support frame 15. The multiple user supports help to provide proper positioning of the user relative to the user engaging portion of the exercise arm throughout the entire exercise movement. This also makes the apparatus much more comfortable and natural for the user, making the user want to exercise. The foot pads keep the user's feet in the same relaxed and supported position throughout the entire exercise movement.

Figure 8:
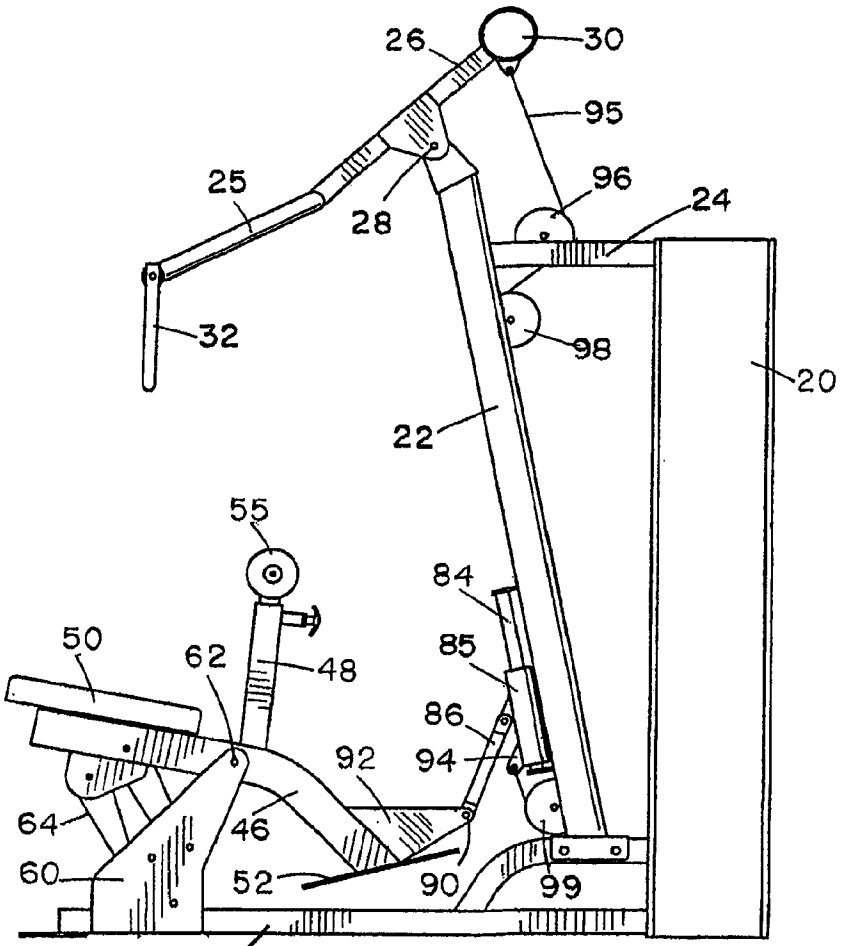
FIG. 8 is a side elevation view similar to FIG. 7, but illustrating the exercise end or finish position of the machine.
Figure 7:
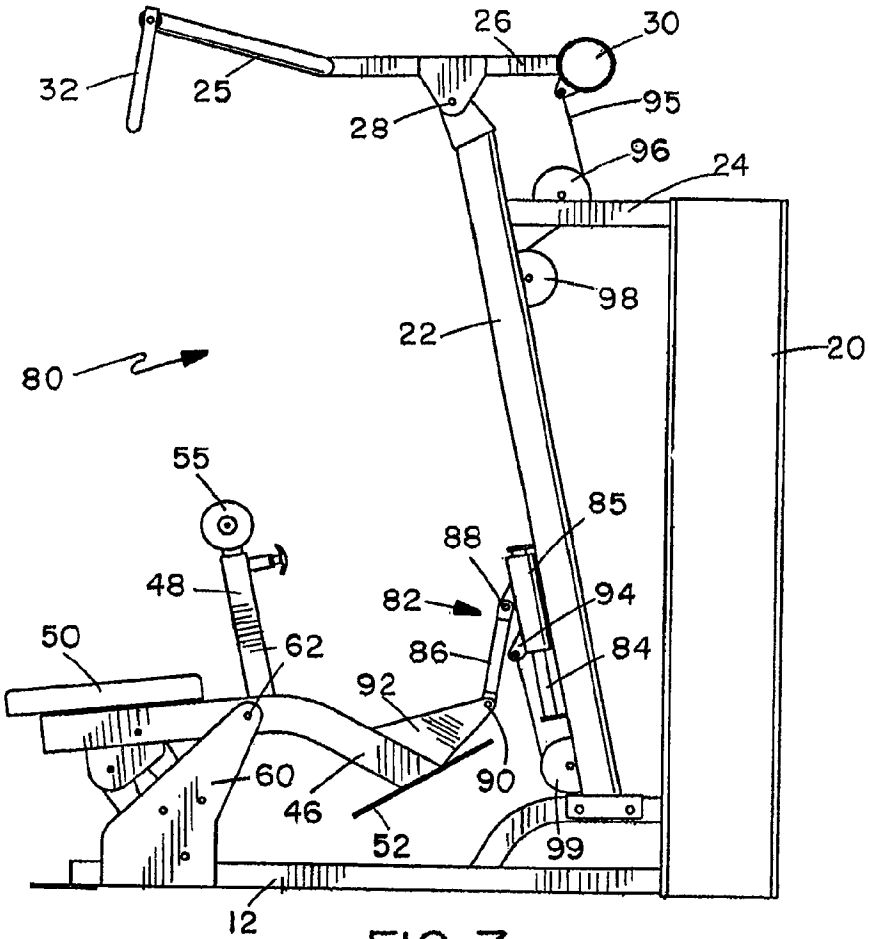
FIG. 7 is a side elevation view similar to FIG. 3, illustrating a lat pull down exercise machine according to a second embodiment of the invention, with the moving parts in an exercise start position.

FIGS. 7 and 8 illustrate a rigid arm lat pull down machine 80 according to a second embodiment of the invention, which is similar in some respects to the machine of FIGS. 1 to 6, and like reference numerals have been used for like parts as appropriate. The main difference between this embodiment and the previous embodiment is the linkage between the user support frame 15 and the exercise arm 18. In this embodiment, the adjustable connecting link 38 of the first embodiment is replaced by a sliding linkage system 82 which pushes the user support frame 15.

The sliding linkage system 82 includes a guide bar 84 mounted on the upright strut 22 of the main frame and a slide 85 slidably mounted to run along the guide bar 84 by any suitable means such as a linear bearing, wheel, or the like. A connecting link 86 is pivotally connected to the slide at one end via pivot 88, and is pivotally connected to the user support frame 15 at its opposite end via a pivot 90 connecting the link 86 to a pivot bracket 92 extending from the forward end of the user support frame. The exercise arm 18 is connected to the slide via a cable and pulley linkage extending from the counter weight 30 to an anchor 94 at the lower end of the slide 85. The cable and pulley linkage comprises a cable 95 extending from the counter weight 30 around a pulley 96 on the horizontal upper strut 24 of the frame, and around pulleys 98,99 on the upright strut 22 before connecting to anchor 94.

The exercise movement in this embodiment will be equivalent to that of FIGS. 1 to 6. The seated user will grip the handle 32 with their arms stretched straight up above their head, in the same position as illustrated in FIG. 5, and will then pull down on the exercise arm 18, which will pivot about pivot 28 at the upper end of strut 22. Downward movement of the end 25 of the exercise arm will in turn move the forward end and counterweight 30 upwards, pulling the cable 95 upwards and simultaneously pulling the slide 85 downwards along guide bar 84. This will cause the connecting link or rod 86 to pivot about its attachments to the slide and user support frame, pushing the front end of the user support down as it pivots about pivot 62. This action forces the user support seat 50 to lift and rotate forward into the final position illustrated in FIG. 8.

The machine of FIGS. 7 and 8 will operate in essentially the same way as that of the previous embodiment, with the user, user support frame, and exercise arm following essentially the same motions as illustrated in FIGS. 5 and 6. It will therefore have the same advantages of closely mimicking the movement of an exerciser when performing a free bar chin up exercise, while holding the user's body safely and securely in the proper orientation.

Figure 10:
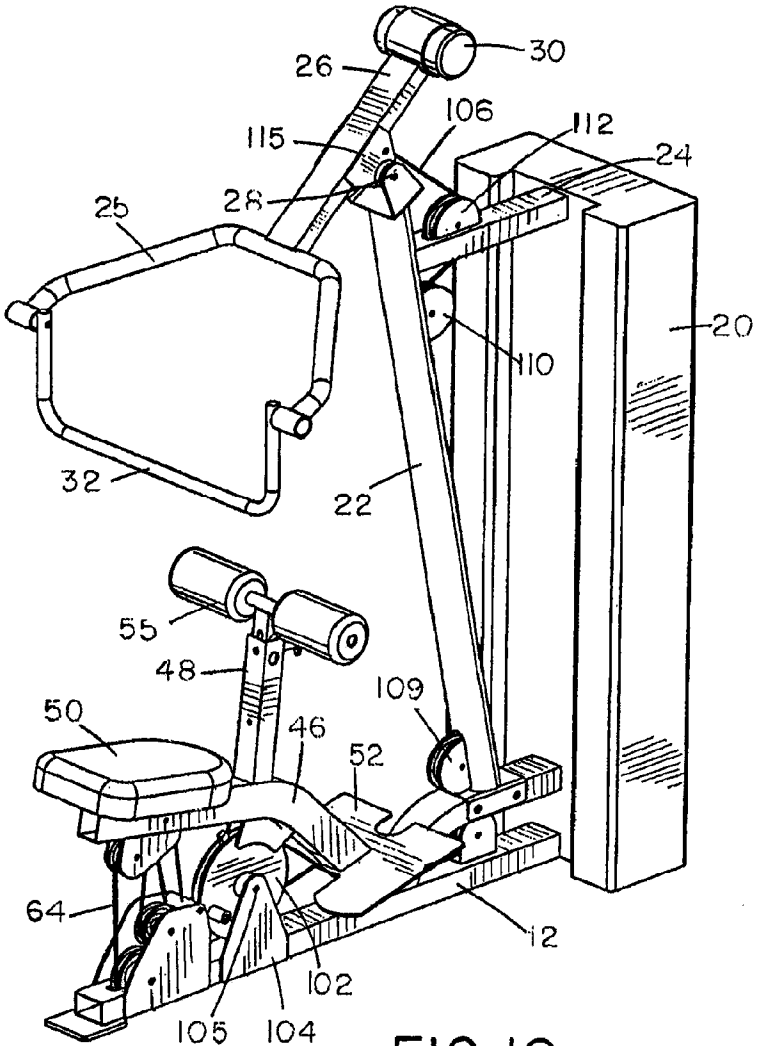
FIG. 10 is a rear perspective view similar to FIG. 9, with the machine in the exercise end position.
Figure 9:
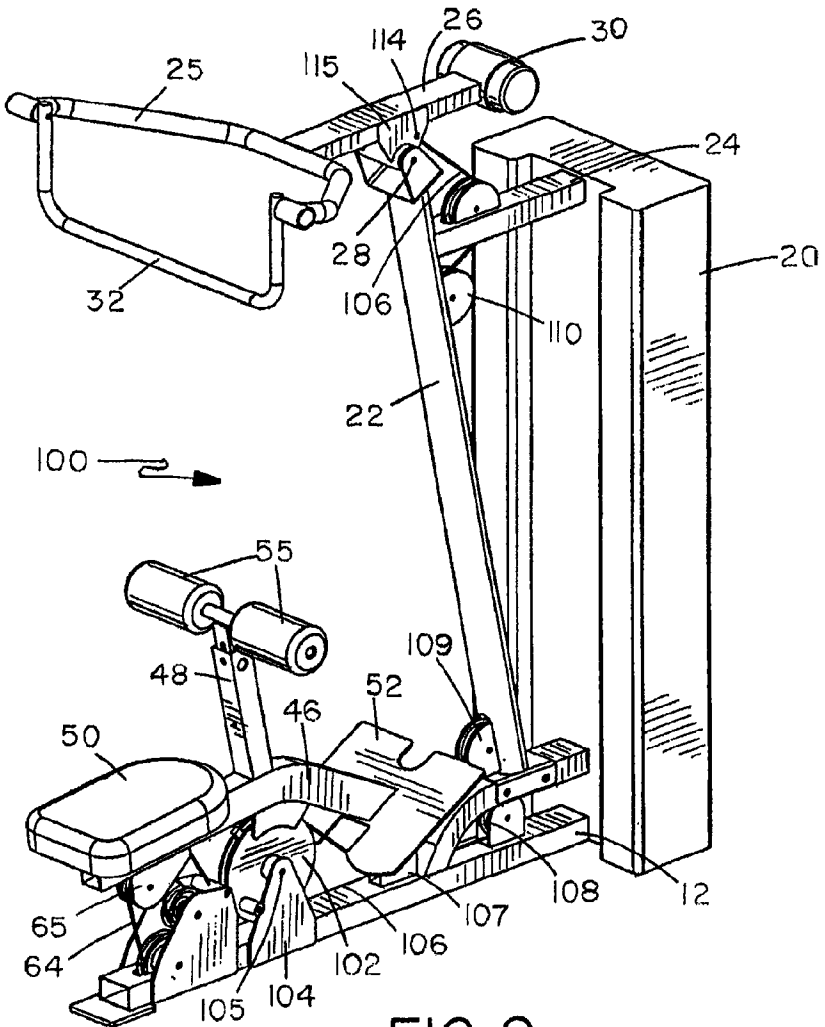
FIG. 9 is a rear perspective view of a lat pull down exercise machine according to another embodiment of the invention, with the machine illustrated in a start position adopted at the start of an exercise movement.

FIGS. 9 and 10 illustrate another modified pull down exercise machine 100 which is similar to that of FIGS. 1 to 6 but has a modified pivot mount for the user support frame, as well as a modified linkage between the user support frame and exercise arm. All elements which are identical to equivalent elements in FIGS. 1 to 6 have been given like reference numerals. In the exercise machine 100, the base member 46 of the user support is mounted on a round cam 102 which in turn is pivotally mounted on pivot mounting plates 104 on the base 12 of the main frame, via pivot pin 105. The exercise arm 18 is linked to the cam 102 by a cable and pulley assembly, which comprises a cable 106 having a first end anchored to the cam 102 and extending from the cam around spaced pulleys 107, 108 on the base 12, and then around pulleys 109,110 on the upright strut 22, and a pulley 112 on the horizontal upper strut 24. The cable then extends from pulley 112 to an anchor 114 on a pivot mounting plate 115 on arm 18, adjacent to the pivot connection 28 to the upper end of the strut 22.

Again, this machine will operate in substantially the same way as illustrated in FIGS. 1 to 6 for the first embodiment, with the start and finish positions being equivalent to those illustrated in FIGS. 5 and 6 for the first embodiment. When the seated user pulls down on the handle 32, cable 106 is pulled up, which rotates the cam 102 in a clockwise direction about pivot pin 105, causing the user support to pivot forward about pivot 62 and the seat to rotate upward into the forwardly inclined finish position.

Figure 11:
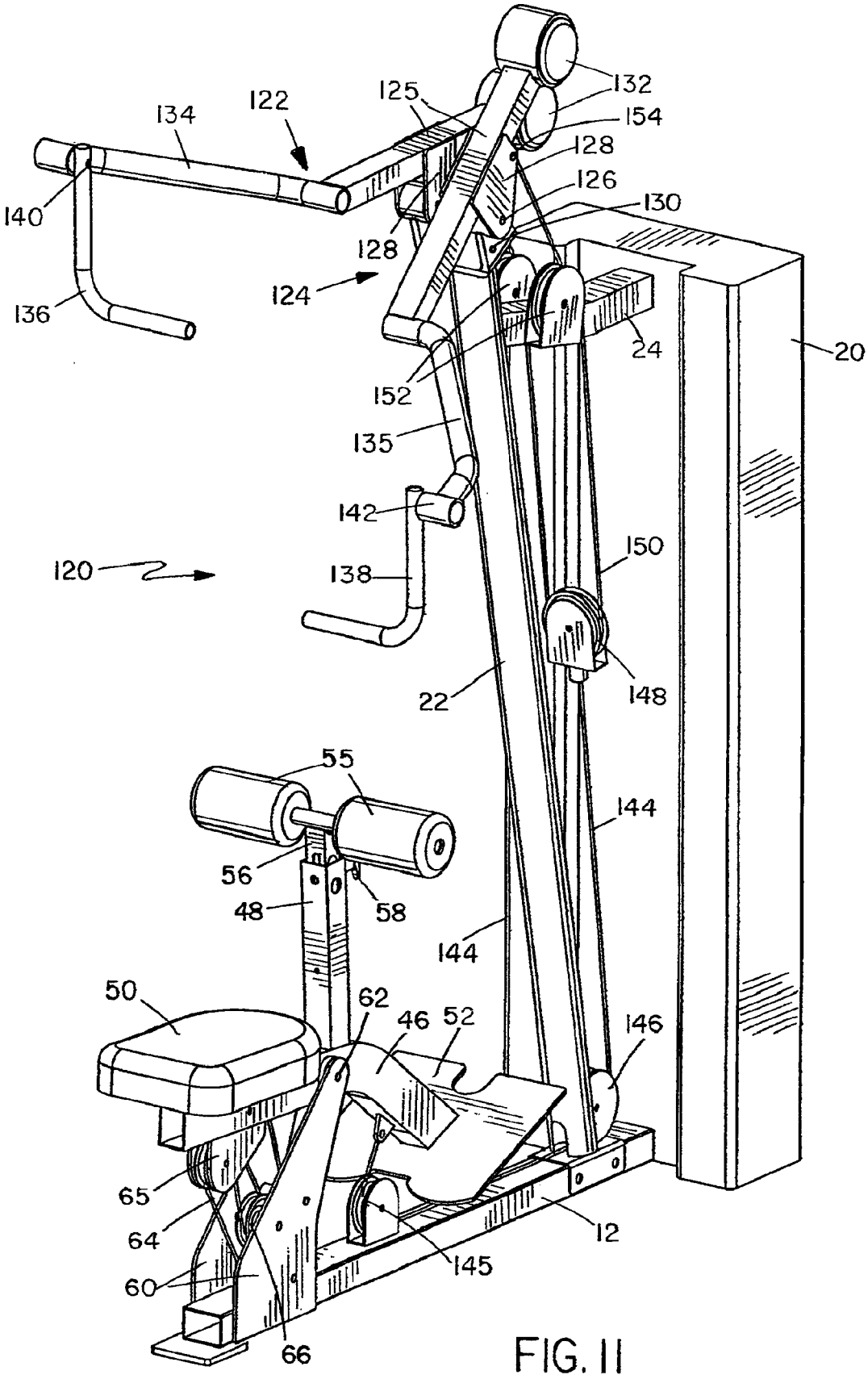
FIG. 11 is a rear perspective view of a rigid arm lat pull down machine according to another embodiment of the invention, in which the single-piece exercise arm is replaced with a split, two-piece arm system.

FIG. 11 illustrates a rigid arm pull down machine 120 according to another embodiment of the invention. All the previous embodiments have a one piece exercise arm for dependent arm movement, whereas this embodiment has a split, two piece arm system. As in the previous embodiments, the machine 120 comprises a main frame having a horizontal base section 12 and an upright section 14, and a generally T-shaped user support frame 15 pivotally mounted on the base section via pivot mount 16. The upright section 14 of the frame includes a vertical housing 20 containing a weight stack (not visible in the drawing), and a slightly rearward inclined upright strut 22. A horizontal strut 24 extends between the top of housing 20 and the upright strut 22.

The user support frame 15 is generally T-shaped and identical to that of the first embodiment, having a base member 46 and an upright member 48 projecting upwardly from the central region of member 46. A seat pad or primary support 50 is mounted at the rear end of base member 46, in front of upright member 48, and a foot rest or stabilization means 52 is mounted at the forward end of member 46. A secondary user support for holding down the user's thighs is provided at the upper end of upright member 48, and comprises a pair of roller pads 55 on a strut 56 telescopically mounted in member 48. The position of the roller pads 55 can be adjusted by moving strut 56 up or down and then securing it in position via a spring loaded pull pin 58.

The user support frame 15 is pivotally mounted on the base section 12 of the main frame via a pair of pivot mounting plates or brackets 60 secured to the base section 12 and having upper ends pivoted to the base member 46 of the user support frame via pivot pin 62. The rear end of the base member 46 is linked to the weight stack via a cable and pulley assembly, only part of which is visible in the drawings. Cable 64 extends over pulleys mounted between mounting plates 65 secured beneath base member 46 and over pulleys 66 mounted between pivot mounting brackets 60, and then runs through the base section 12 of the frame and into the weight stack housing, where it extends over further pulleys (not visible in the drawings) before linking with the weight stack in a conventional manner.

As noted above, in this embodiment, the single exercise arm 18 of the previous embodiments is replaced with a split, two-piece exercise arm system for providing unilateral or independent arm action. The exercise arm system is equivalent to the previous arm 18, but split into two halves or arms 122,124 along its longitudinal central axis. Each arm 122, 124 has a first, generally straight portion 125 pivoted at an intermediate point in its length to the upper end of upright strut 22 via pivot pin 126 extending through pivot brackets 128 secured to portion 125 of the arm and one side of a U-shaped pivot bracket 130 secured to the upper end of strut 22. A counterweight 132 is secured to the end of the arm portion 125 and has an equivalent function to the counterweight 30 of the previous embodiments. Each arm 122, 124 has an end portion 134,135, respectively which is a half U-shape, and a handle arm 136,138 pivotally secured to the end of the respective end portion 134,135 via pivot pin 140,142, respectively.

In this embodiment, the user support frame is linked to the two exercise arms 122, 124 via a cable and pulley linkage. A first cable 144 is attached to the underside of the base member 46 of the user support frame at its first end, and is then reeved around pulleys 145,146 mounted on the base of the main frame and connected to a single floating pulley 148 at its second end. A second cable 150 is reeved around the floating pulley 148, over a pair of guide pulleys 152 on opposite sides of horizontal strut 24, and is then pivotally connected to each of the exercise arms 122, 124 at anchor 154.

It will be understood that the split arm system of FIG. 11 may replace the single exercise arm of any of the previous embodiments if independent arm action is desired. In the exercise machine of FIG. 11, the general exercise motion of the user, user support frame and exercise arms will be equivalent to that of the first embodiment. When one or both of the exercise arms 122,124 is pulled downward, the cable 150 will be pulled upwards, pulling up the floating pulley 148, and in turn pulling on cable 144, which urges the user support frame to rotate upwards and forwards about pivot 62, lifting the seat towards the upwardly inclined exercise finish position. If only one exercise arm is pulled, the user support will travel half the distance towards the end position. If both arms are pulled down simultaneously, the user support will travel all the way to the end position. This design forces equal resistance to each of the exerciser's arms and provides a more balanced workout. It allows the user to work one arm at a time, as indicated in FIG. 11, and will require more co-ordination if both arms are worked together. This machine will have all the advantages and benefits as described above in connection with the previous embodiments, with the added advantage of allowing a user to work their arms independently.

Figure 13:
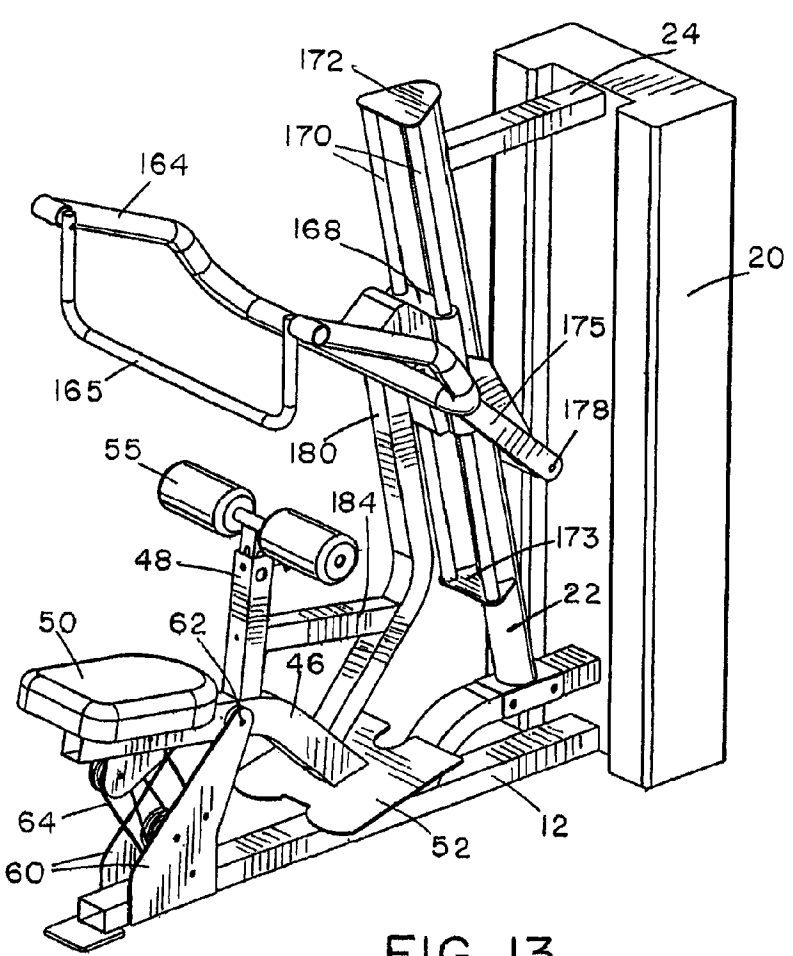
FIG. 13 is a rear perspective view similar to FIG. 12, with the machine in the exercise end position.
Figure 12:
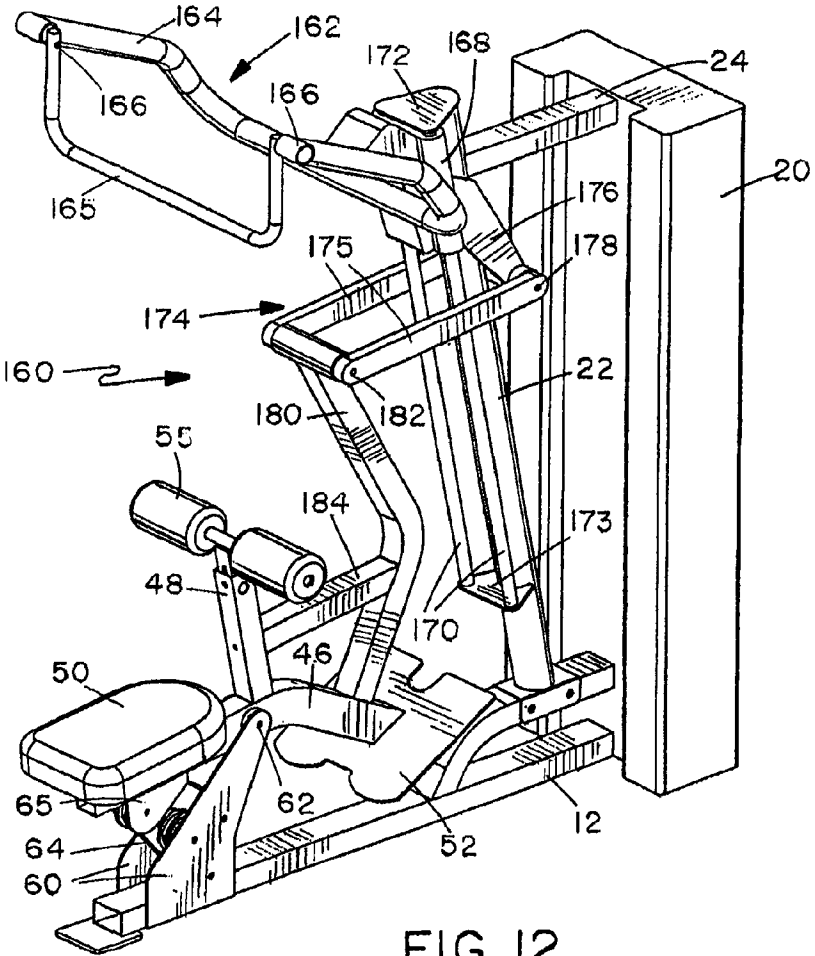
FIG. 12 is a rear perspective view of a lat pull down exercise machine according to another embodiment of the invention, with the machine illustrated in a start position adopted at the start of an exercise movement.

FIGS. 12 and 13 illustrate a rigid arm pull down exercise machine 160 according to another embodiment of the invention, in which the user support frame, user support mount, and machine frame are similar to the previous embodiments, but the pivoted exercise arm or arms of the previous embodiments is replaced by a linear movement exercise arm 162. As in the previous embodiments, the machine 160 comprises a main frame having a horizontal base section 12 and an upright section 14, and a generally T-shaped user support frame 15 pivotally mounted on the base section via pivot mount 16. The upright section 14 of the frame includes a vertical housing 20 containing a weight stack (not visible in the drawing), and a slightly rearward inclined upright strut 22. A horizontal strut 24 extends between the top of housing 20 and the upright strut 22.

The user support frame 15 is generally T-shaped and identical to that of the first embodiment, having a base member 46 and an upright member 48 projecting upwardly from the central region of member 46. A seat pad or primary support 50 is mounted at the rear end of base member 46, in front of upright member 48, and a foot rest or stabilization means 52 is mounted at the forward end of member 46. A secondary user support for holding down the user's thighs is provided at the upper end of upright member 48, and comprises a pair of roller pads 55 on a strut 56 telescopically mounted in member 48. The position of the roller pads 55 can be adjusted by moving strut 56 up or down and then securing it in position via a spring loaded pull pin 58.

The user support frame 15 is pivotally mounted on the base section 12 of the main frame via a pair of pivot mounting plates or brackets 60 secured to the base section 12 and having upper ends pivoted to the base member 46 of the user support frame via pivot pin 62. The rear end of the base member 46 is linked to the weight stack via a cable and pulley assembly, only part of which is visible in the drawings. Cable 64 extends over pulleys mounted between mounting plates 65 secured beneath base member 46 and over pulleys 66 mounted between pivot mounting brackets 60, and then runs through the base section 12 of the frame and into the weight stack housing, where it extends over further pulleys (not visible in the drawings) before linking with the weight stack in a conventional manner.

The exercise arm 162 basically comprises a U-shaped yoke member 164 having opposite ends pivotally connected to the corresponding ends of a U-shaped handle 165 via pivots 166. A linear bearing assembly or slide member 168 is mounted on the central portion of the U-shaped yoke member and is slidably engaged on parallel guide bars 170 mounted on the forward side of the upright strut 22 via end mounting plates 172,173. This provides linear sliding movement of the exercise arm 162 along the strut 22. However, wheels, bushings, or any other linear sliding mechanism may be used in place of the linear bearing assembly 168. A connecting link 174 pivotally connects the exercise arm 162 with the user support frame 15. The connecting link comprises a pair of bars 175 each pivotally connected at one end to a respective pivot bracket 176 mounted on the linear bearing assembly 168 via pivots 178. An upright strut 180 projects generally upwardly from the base member 46 of the user support frame, from a location adjacent the foot plate 52, and the second end of each bar 175 is pivoted to the upper end of strut 180 via pivot pin 182. A brace 184 extends between the upright member 48 of the user support and the upright strut 180 for added support.

Again, the actual exercise motion provided by this machine is equivalent to that described above in connection with FIGS. 1 to 6. The machine starts in the position of FIG. 12, with the seat pad 50 in a slightly downwardly reclined orientation, such that the user's upper body will adopt the slight forward inclination illustrated in FIG. 5, and the user will reach their arms straight upwardly above their head in order to grip the handle 165. As the handle 165 and exercise arm is pulled downward, the slide member 168 will slide down along the bars 170, and the connecting link 174 will pivot about the pivots 178 and 182, generally pulling the upright strut 180 upwardly and forward, and pulling the front end of the user support downwards into the position of FIG. 13, rotating the user support frame about pivot 62 so that the seat pad 50 adopts a slightly upwardly inclined orientation at the end of the exercise movement.

In this embodiment, the resistance is again connected to the user support frame via the partially illustrated cable and pulley linkage. A counter-balance (not illustrated) attached to the exercise arm 162 via a cable and pulley system (not illustrated but well known in the art) may be used to keep the exercise arm in the elevated, start position of FIG. 12 when the machine is not in use.

In each of the embodiments described above, the weight stack resistance may be replaced by any other suitable exercise resistance, such as hand-loaded plates mounted on receiving pegs, elastic bands, pneumatic resistance, or the like. The resistance cable may be connected directly to the exercise arm rather than to the user support frame. In the latter case, the minimum starting weight of the weight stack could be set high enough to act as a counter-balance and offset the weight of the exercise arm, thus keeping it in the elevated position.

Figure 15:
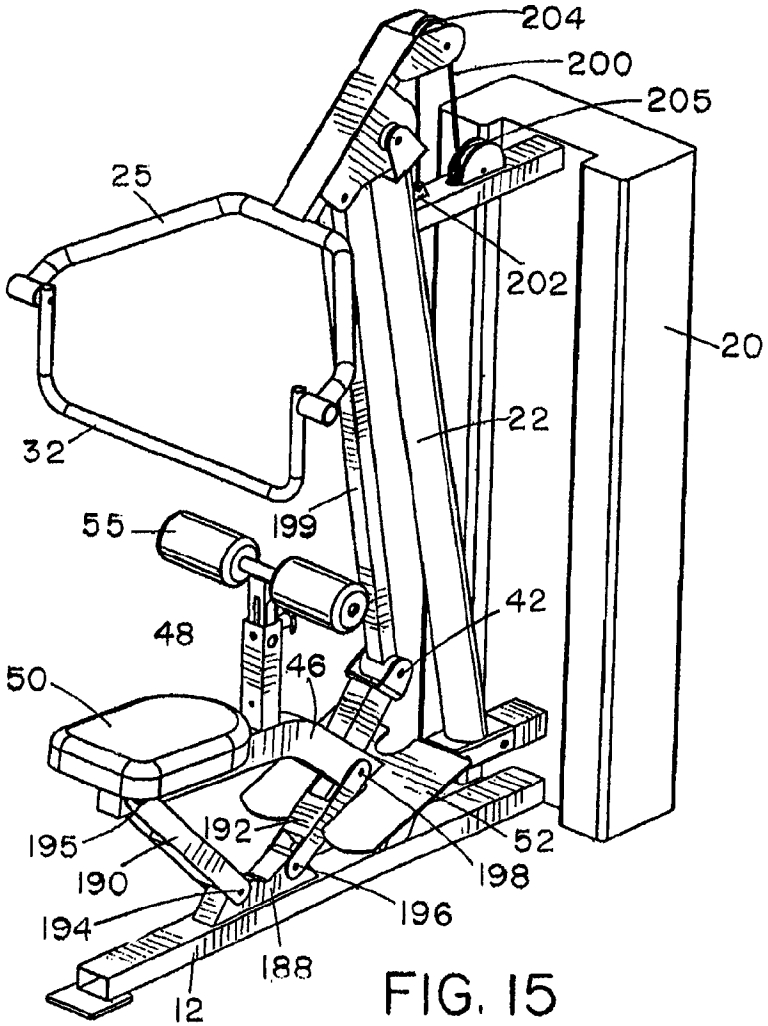
FIG. 15 is a rear perspective view similar to FIG. 14, with the machine in the exercise end position.
Figure 14:
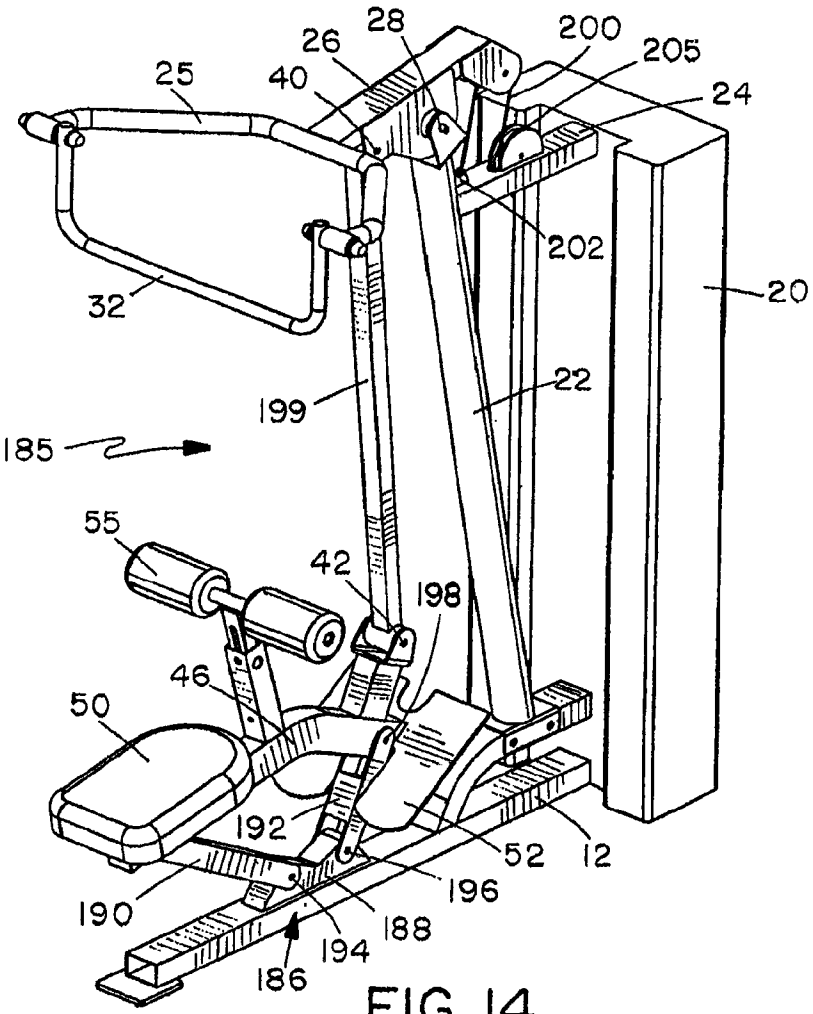
FIG. 14 is a rear perspective view of a lat pull down exercise machine according to another embodiment of the invention, with the machine illustrated in a start position adopted at the start of an exercise movement.

FIGS. 14 and 15 illustrate another modified rigid arm pull down exercise machine 185 which is similar to that of FIGS. 1 to 6, and like reference numerals have been used for like parts as appropriate. However, the user support frame mount on the main frame is different from that of FIGS. 1 to 6, and comprises a four bar linkage assembly 186. The four bar linkage system comprises the base strut 46 of the user support, a pivot mount 188 on the base 12 of the main frame, and a pair of lever arms 190,192. The first lever arm 190 is longer than the second lever arm 192 and is pivoted at one end to the rear end of pivot mount 188 via pivot 194, and to the rear end of base strut 46 at the opposite end, via pivot 195. The second lever arm 192 is pivoted at one end to the forward end of the pivot mount 188 via pivot 196, and at the opposite end to the forward end of the base strut 46 via pivot 198, adjacent foot plate 52. A connecting link 199, in this case non-adjustable, connects the exercise arm with the user support.

In addition to the user support mount, the embodiment of FIGS. 14 and 15 differs from the previous embodiments since the exercise arm 18 is linked to the weight stack in this case, rather than the user support frame. A cable 200 extends from an anchor 202 on the horizontal frame strut 24, around a pulley 204 secured to the end of the portion 26 of the exercise arm, and around a second pulley 205 on the strut 24, before extending into the weight stack housing where it will be secured to the weight stack in a conventional manner.

When the exercise arm 18 is pulled downward by a user gripping handle 32, the connecting link 199 will force the user support frame 15 to pivot via the two links or lever arms 190, 192 which connect it to the main frame. The longer, rear lever arm 190 lifts the seat 50 of the user support frame, while the shorter, forward lever arm 192 causes the foot rest section to drop downward. This combined action of the first and second links or lever arms of the four bar linkage results in upward rotation of the user support, similar to the movement found in the other embodiments. In this embodiment, as noted above, the exercise resistance or load is linked to the exercise arm. Downward movement of the handle end of the exercise arm rotates the opposite end of the arm upward and outward, pulling the cable 200 and lifting the weight stack.

Figure 17:
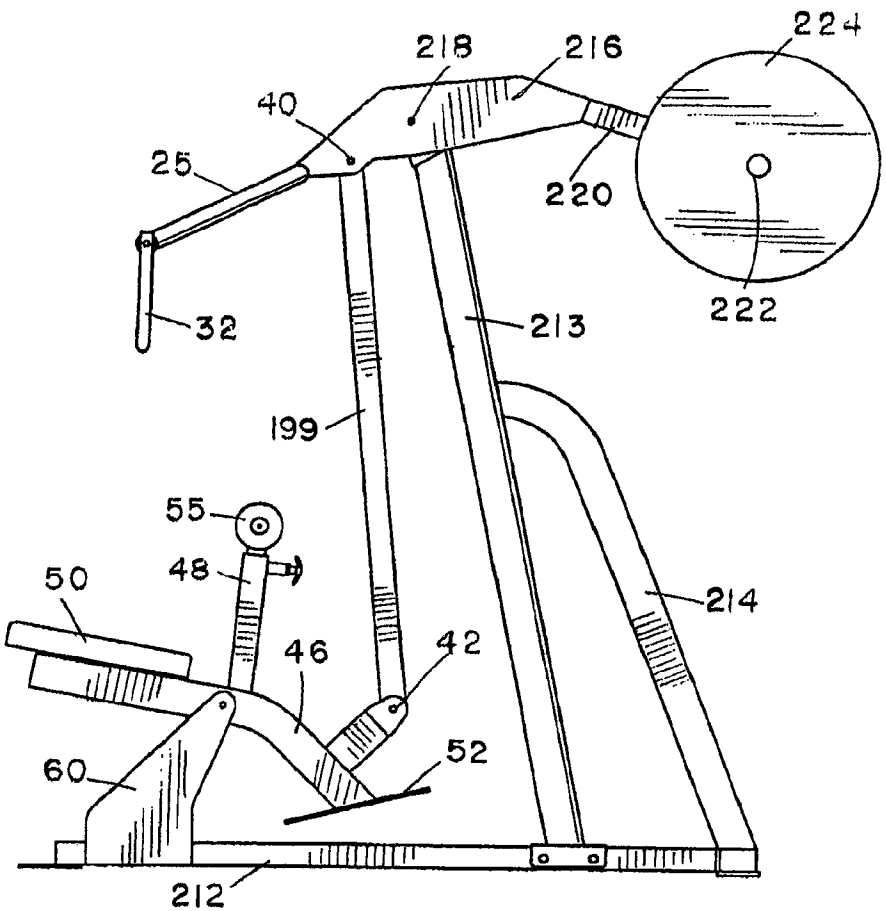
FIG. 17 is a side elevation view similar to FIG. 16, with the machine in the exercise end position.
Figure 16:
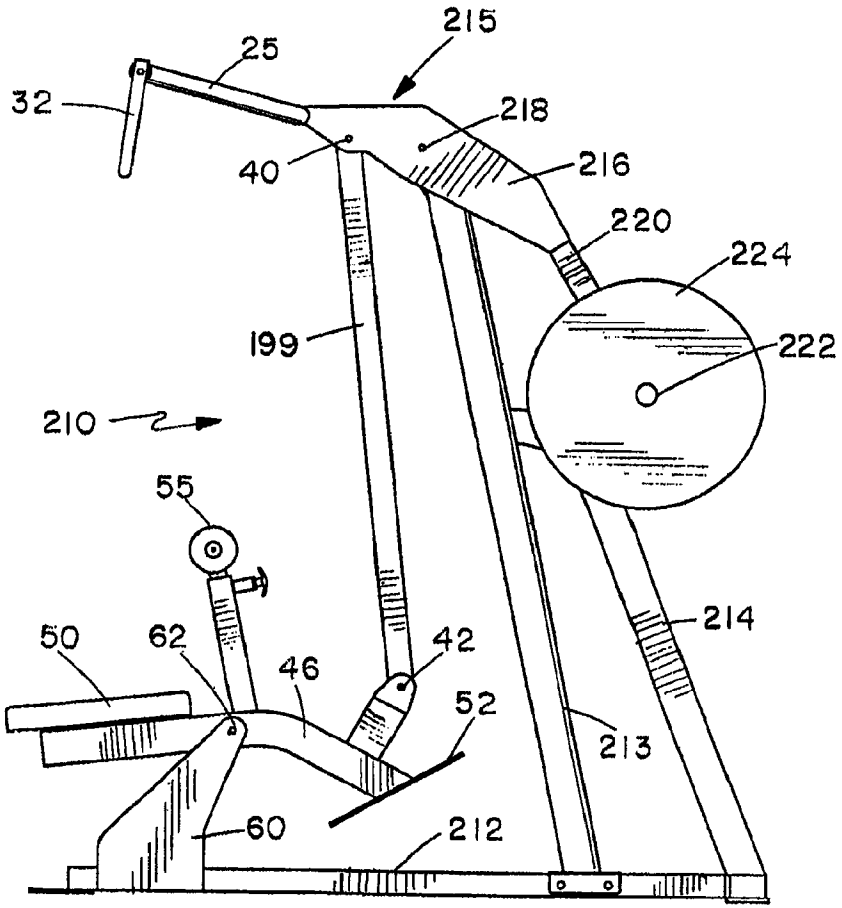
FIG. 16 is a side elevation view illustrating a modification of the machine of FIGS. 1 to 5, in which the weight stack is replaced with plate-loaded resistance, with the machine illustrated in a start position adopted at the start of an exercise movement.

FIGS. 16 and 17 illustrate another modified pull down exercise machine 210 in which the weight stack of the previous embodiments is replaced by a plate-loaded resistance. The main frame of the exercise machine is similar to the previous embodiments with the exception of the weight stack housing, which has been eliminated. The main frame basically comprises a base strut 212 with a user support frame 15 equivalent to the previous embodiments pivotally mounted at its rear end, and an inclined upright strut 213 extending upwardly at a location adjacent its forward end, with a second upright strut 214 extending from the forward end of the base strut 212 and secured to the upright strut 22 to act as a brace. An exercise arm 215 has a central portion 216 pivotally mounted on the upper end of strut 213 via pivot 218, and a rearwardly extending portion comprising a U-shaped yoke member 25 and downwardly depending, pivoted handle bar 32 similar to the first embodiment. The exercise arm has a forward end 220 which has weight receiving pegs 222 projecting from its opposite sides, for selective loading of weight plates 224. As in the previous embodiment, the exercise arm is pivotally linked to the user support frame via a connecting link 199, which may be replaced by the adjustable connecting link 38 of the first embodiment if desired.

The machine 210 of FIGS. 16 and 17 will operate in exactly the same way as the machine of FIGS. 1 to 6, moving from the start position of FIG. 16 to the finish position of FIG. 17 when a seated user pulls down on handle 32. It will have the same general exercise movement and advantages as the previously described embodiments.

In each of the foregoing embodiments, the exercise arm pivot is positioned forward of the user support and in front of the user. FIGS. 18 to 21 illustrate a rigid arm pull down machine 230 according to another embodiment of the invention in which the exercise arm pivot is located rearward of the user support. The machine 230 has a main frame comprising a horizontal base 232, a rearwardly and upwardly inclined upright strut 234, a pivot mount 235 extending upwardly from the base 232, and an upright weight stack housing 236 at the forward end of base 232. The housing contains a conventional selectorized weight stack. A generally L-shaped user support frame 238 is pivotally mounted at the upper end of pivot mount 235 via pivot 239. The user support frame 238 has a first or base portion 240 on which a seat pad 242 is mounted, and a second or upright portion 244 on which a back pad 245 is mounted. The pivot 239 is located on the base portion 240 beneath seat pad 242. A generally upright support member 246 is secured to the forward end of the base portion 240 of the user support frame, and a thigh hold down comprising a pair of thigh hold down roller pads 248 is adjustably mounted at the upper end of the support member 246. A thigh pad mounting strut 250 is telescopically engaged in the upper end of the upright support member or strut 246 and secured in a selected position via a releasable pull pin 252. A foot support plate 254 is secured to the lower end of the support member 246.

An exercise arm 256 is pivotally mounted at the upper end of the upright strut 234 so as to extend forwardly on opposite sides of the user support frame. Arm 256 comprises a pair of parallel, generally V-shaped plates 258 with lower ends pivotally mounted on opposite sides of upright strut 234 via pivot pin 260, a U-shaped exercise arm having a central section 262 secured to the apex of plates 258, and opposite handle arms 264 projecting forwardly from plates 258 on opposite sides of the user support frame. A connecting link 265 is pivotally connected at one end to the upper end of the V-shaped plates 258 via pivot 266, and at the opposite end to the upper end of the upright 244 of the user support frame via pivot 268. The user support frame is linked to the weight stack via a cable and pulley linkage comprising a cable 270 extending from an anchor 272 on an upright portion 274 of the main frame, around a pulley 275 on the rear of the upright 244 of the user support frame, and then back around a pulley 276 in the upright portion 274, before extending through the base 232 and into the weight stack housing for connection to the weight stack in a conventional manner. Cooperating stop pads 278, 279 on the frame upright 274 and on the rear of the user support upright 244 engage one another to support the user support frame in the exercise start position of FIGS. 18 and 20.

Figure 18:
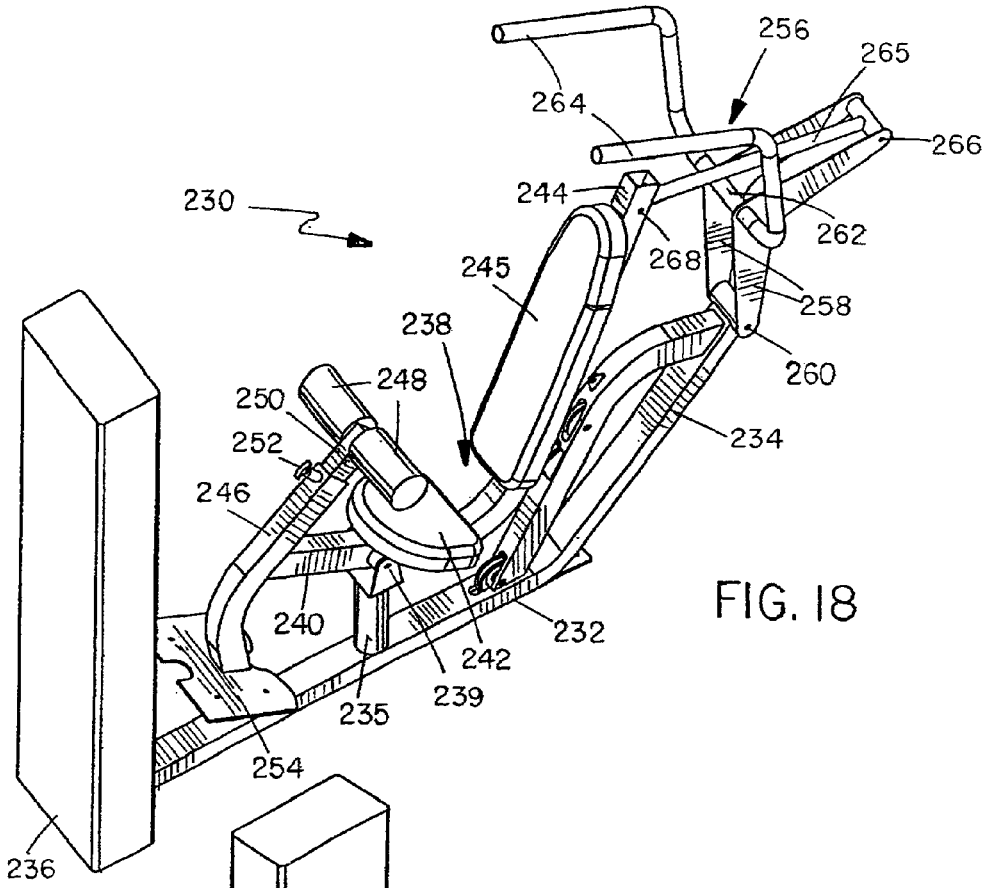
FIG. 18 is a front perspective view of a rigid arm lat pull down exercise machine according to another embodiment of the invention with the machine in an exercise start position.
Figure 19:
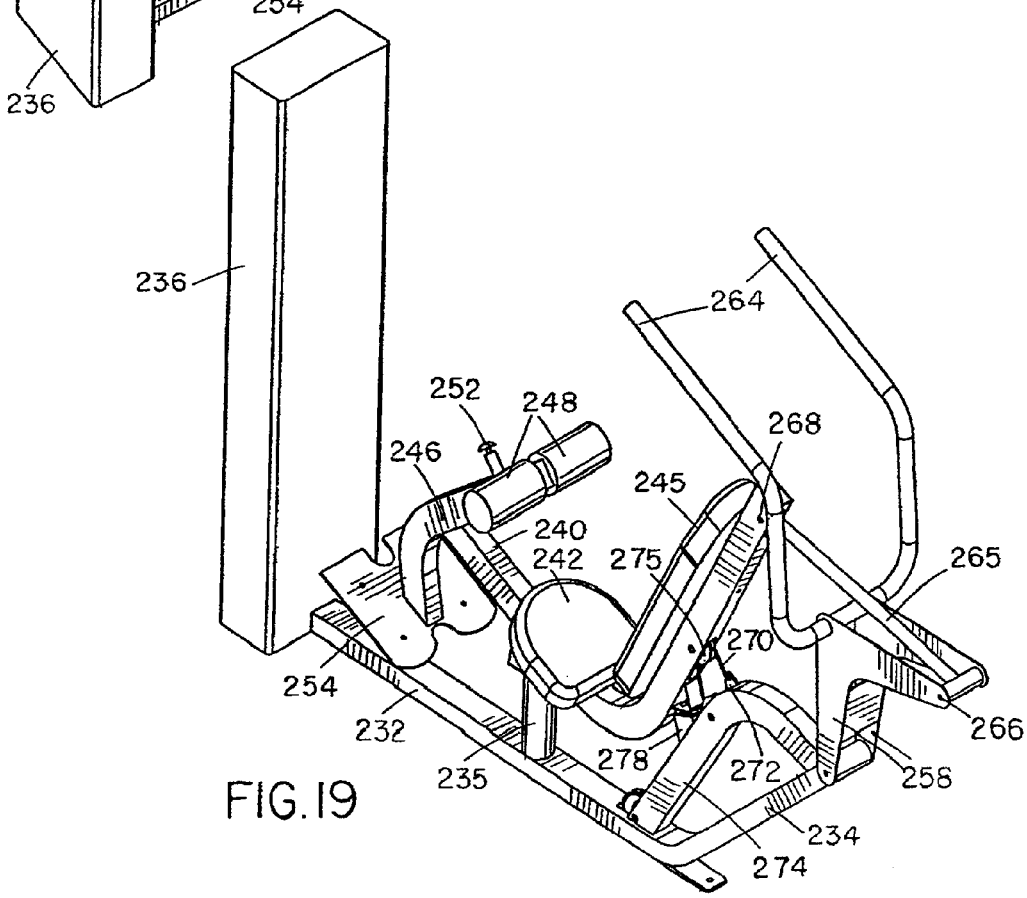
FIG. 19 is a rear perspective view of the machine of FIG. 18.
Figure 20:
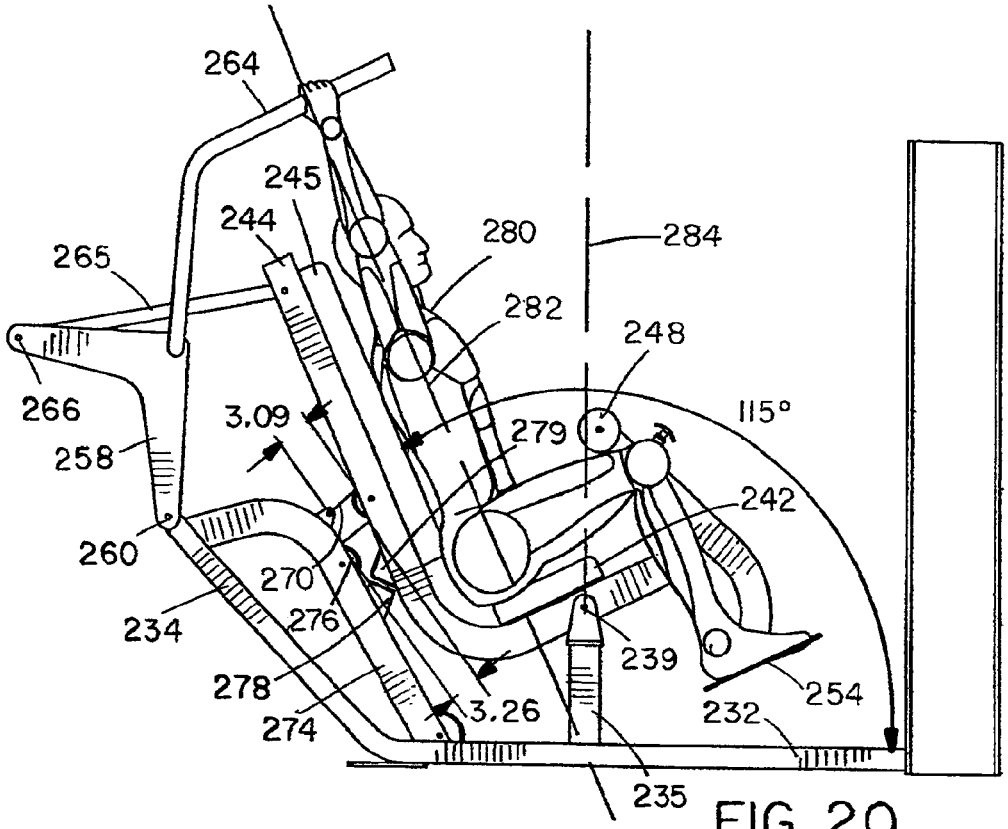
FIG. 20 is a side elevation view of the machine of FIGS. 18 and 19, with a user seated on the user support and the machine and user in a start position adopted at the start of an exercise movement.

As in the embodiments of FIGS. 1 to 17, the machine of FIGS. 18 to 21 is designed for performing an exercise equivalent to a free bar chin up exercise. FIGS. 18, 19 and 20 illustrate the exercise start position, with a user 280 seated on the user support frame in FIG. 20. The two sets of dotted lines 282,284 in FIG. 20 illustrate the side centerline of the user and the perpendicular centerline of the user support pivot 239, which is the gravitational centerline of the user performing the exercise. In order to perform the exercise, the user first sits on the seat pad 242 with their back resting against back pad 245 in a generally rearwardly reclined position, the seat pad being inclined upwardly in this position. They will rest their feet on foot plate 254 with their thighs engaging under the thigh hold down pads 248. The user can adjust the position of the thigh hold down pads 248 to rest on top of their thighs with the pull pin 252, and then release the pull pin to secure the thigh pads in the selected position. When properly positioned on the user support, the user raises their arms above their head in order to grip the handles 264. In this position, the user's arms and hands are in line with the side centerline of the user's body.

Figure 21:
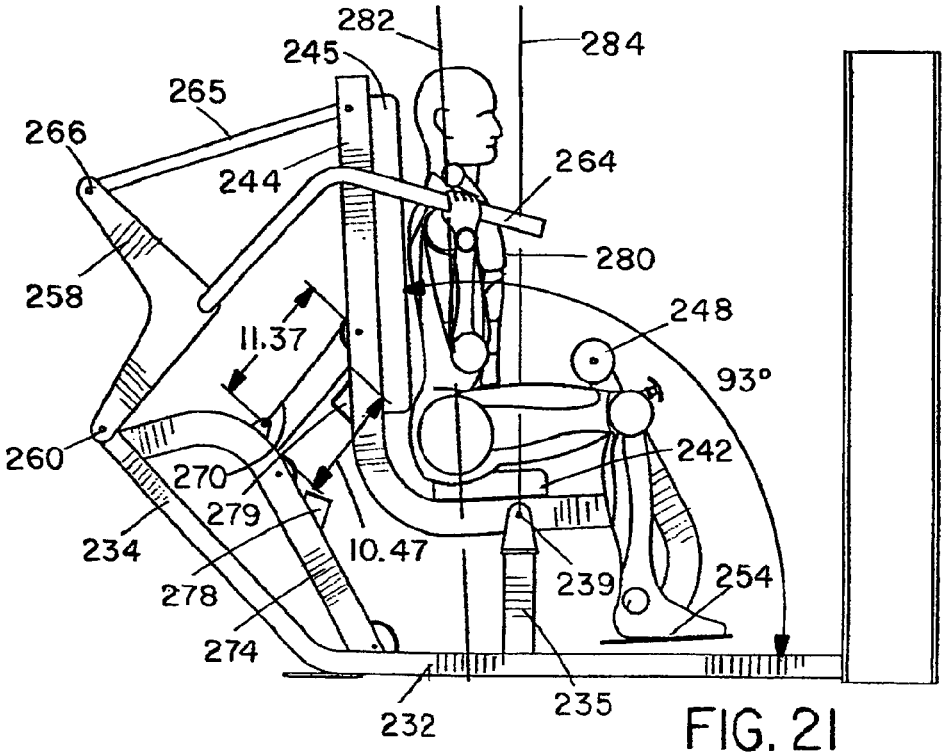
FIG. 21 is a side elevation view similar to FIG. 20 but with the machine and user in the end position after completing an exercise movement.

From the position illustrated in FIG. 20, the user pulls down on the handles 264, rotating the exercise arm 256 about its pivotal connection 260 to the upright frame strut 234 and pulling the plates 258 forwards, until the user's hands are positioned under the chin and slightly forward and just above the shoulders. This causes the connecting link to push on the upper end of the rear upright 244 of the user support, resulting in upward and forward movement of the user support about pivot 239. The user support rotates into the upright finish or end position of FIG. 21, with the user also moving into an upright, substantially vertical position. This movement is equivalent to the positioning the user's upper body would have when performing a free bar chin up exercise, as in the case of the first embodiment of FIGS. 1 to 6. Because the exercise arm and user support move in the same direction and have the ability to self-align throughout the exercise movement, the handles can be angled to provide a more comfortable starting and finishing position for the user's hands and wrists, as can be seen in FIGS. 20 and 21.

As illustrated in FIG. 20, the gravitational centerline 284 runs through the lower portion of the user's thigh, adjacent the thigh hold down rollers, in the start position. This places a portion of the user's weight and the user support frame weight on both sides of the gravitational centerline, with the larger percentage being to the rear of the centerline 284. While the majority of the exerciser starts at some distance rearward of the gravitational centerline, they rotate up very close to this centerline during the exercise, and finish with the centerline 284 bisecting their upper thigh, as in FIG. 21. This provides for a more evenly balanced distribution of weight at the end of the exercise. The combined weight of the user and user support has a reduced effect on the amount of starting resistance because a portion of the weight is placed forward of the user support pivot, acting as a counterbalance to the arm. By the same token, as the user moves forward and a larger percentage of their body approaches or passes through the centerline, there is no appreciable drop off in resistance felt, because of the combined weight which remains to the rear of the gravitational centerline.

The combined movement of the user support and exercise arm provides a safer, more interesting, and more natural feeling exercise motion. In this embodiment, unlike the first embodiment, the exercise arm pivot is placed to the rear of the user and user support, behind the user's back. The movement of the user's body from a rearwardly reclined to an upright position does not feel awkward because the user is in a stable, back supported position throughout the entire exercise movement, and they do not have to alter their position on the user support. The user is properly braced with a secondary support, and also has a foot plate which travels with the user support for more stability and comfort. The rocking motion of the user support throughout the exercise makes the exercise more fun to perform.

Although the connecting link 265 in the illustrated embodiment is arranged to push on the back of the user support upright in order to rotate the user support into the finish position, it will be understood that it may alternatively be modified in order to pull on the user support. In this alternative, the exercise arm pivot mounting plates will have a forward end pivoted to the exercise arms or handle arms, a rear end pivoted to the connecting link, and an intermediate point pivoted to the frame upright strut 234. The connecting link will have a forward end pivoted to the underside of the base 240 of the user support, at a location in front of the user support pivot mount 235. In this case, when the handle arms are pulled down, the rear end of the pivot mounting plate will pivot rearward and upward, pulling the rear end of the connecting link, which in turn will pull down on the forward end of the user support base 240, pivoting it downwardly into the upright finish position in which the upright 244 is generally vertical.

Figure 22:
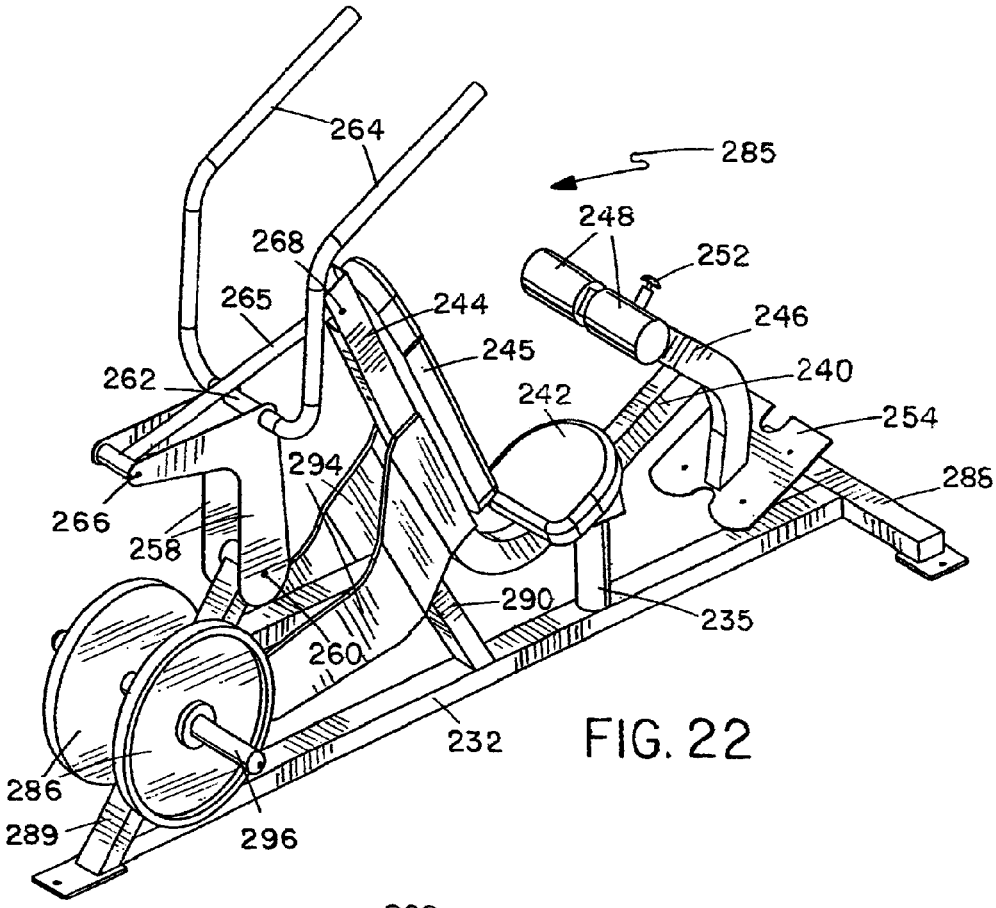
FIG. 22 is a rear perspective view of a lat pull down exercise machine according to another embodiment of the invention, with the machine illustrated in a start position adopted at the start of an exercise movement.
Figure 23:
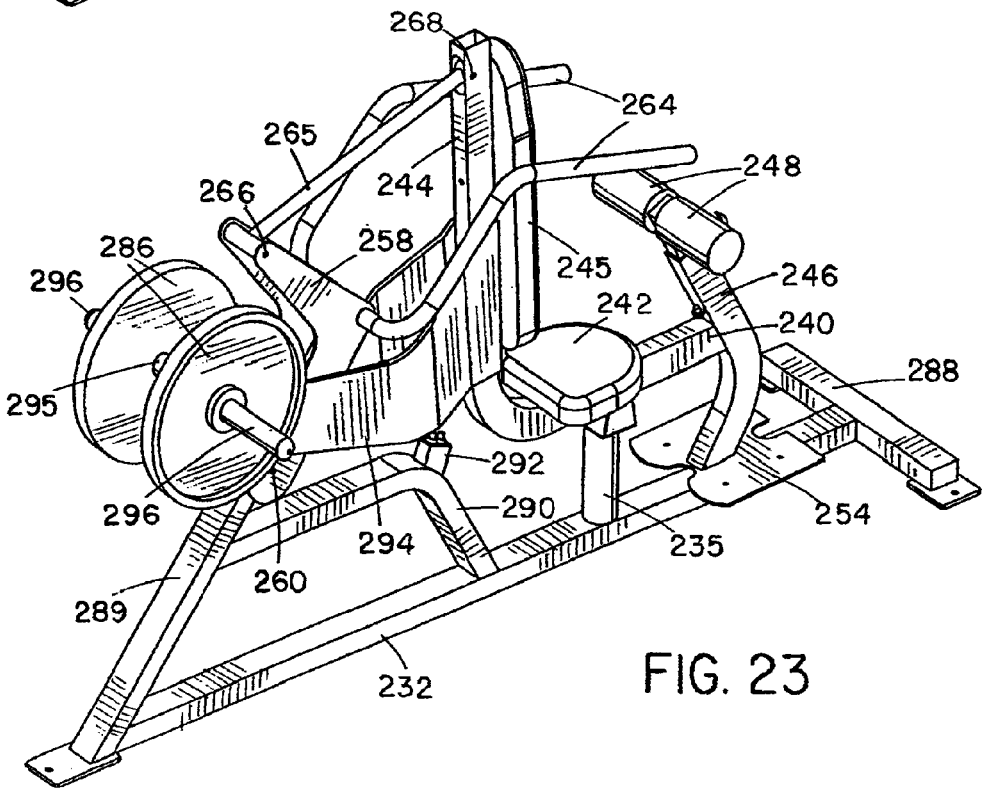
FIG. 23 is a rear perspective view similar to FIG. 22, with the machine in the exercise end position.

FIGS. 22 and 23 illustrate an exercise machine 285 similar to that of FIGS. 18 to 21, apart from the fact that the weight stack of the previous embodiment is replaced with hand-loaded weight plates 286. Apart from the exercise resistance, and some modifications in the main frame, the machine 285 is the same as that of the previous embodiment, and like reference numerals have been used for like parts as appropriate. The machine 285 has a main frame with a base strut 232 having a cross member 288 at its forward end, and a forwardly inclined strut 289 extending upwardly at its rear end. A generally L-shaped brace strut 290 extends upwardly and slightly rearwardly from an approximately central portion of the base strut, and then extends rearwardly in a generally horizontal orientation to meet the rear strut 289. A stop pad or rest member 292 is mounted at the bend or corner of the L-shaped brace strut 290, to act as a support or stop for the user support 238 in the start position of FIG. 22.

As in the previous embodiment, a generally L-shaped user support frame 238 is pivotally mounted at the upper end of pivot mount 235 via pivot 239. The user support frame 238 has a first or base portion 240 on which a seat pad 242 is mounted, and a second or upright portion 244 on which a back pad 245 is mounted. The pivot 239 is located on the base portion 240 beneath seat pad 242. A generally upright support member 246 is secured to the forward end of the base portion 240 of the user support frame, and a thigh hold down comprising a pair of thigh hold down roller pads 248 is adjustably mounted at the upper end of the support member 246. A thigh pad mounting strut 250 is telescopically engaged in the upper end of the upright support member or strut 246 and secured in a selected position via a releasable pull pin 252. A foot support plate 254 is secured to the lower end of the support member 246.

Exercise arm 256 is pivotally mounted at the upper end of the upright strut 289 so as to extend forward on opposite sides of the user support frame. Arm 256 comprises a pair of parallel, generally V-shaped plates 258 with lower ends pivotally mounted on opposite sides of upright strut 289 via pivot pin 260, and a U-shaped exercise arm having a central section 262 secured to the apex of plates 258, and opposite handle arms 264 projecting forwardly from plates 258 on opposite sides of the user support frame. A connecting link 265 is pivotally connected at one end to the upper end of the V-shaped plates 258 via pivot 266, and at the opposite end to the upper end of the upright 244 of the user support frame via pivot 268.

A pair of parallel mounting brackets 294 extend rearwardly from opposite sides of the user support upright 244, on opposite sides of the pivoting plates 258, and are secured together at their rear ends by a cross bar 295. Weight supporting pegs 296 project in opposite directions from the brackets 294 for supporting a selected number of weight plates 286, depending on the amount of exercise resistance desired. The plate-loaded exercise machine of FIGS. 22 and 23 will operate in exactly the same manner as the weight stack loaded machine of FIGS. 18 to 21, with exactly the same exercise start and finish positions. The seated user will reach straight up above their head to grip the handle arms 264 with the machine in the position of FIG. 22, and will then pull down on the arms, lifting pivot 266 upwardly and forward to push the upper end of the user support upright strut 244 forward, lifting the weight plates and rotating the user support about its pivot mount into the upright position of FIG. 23 at the end of the exercise. This machine will therefore have all of the advantages described above in connection with the previous embodiment.

Figure 24:
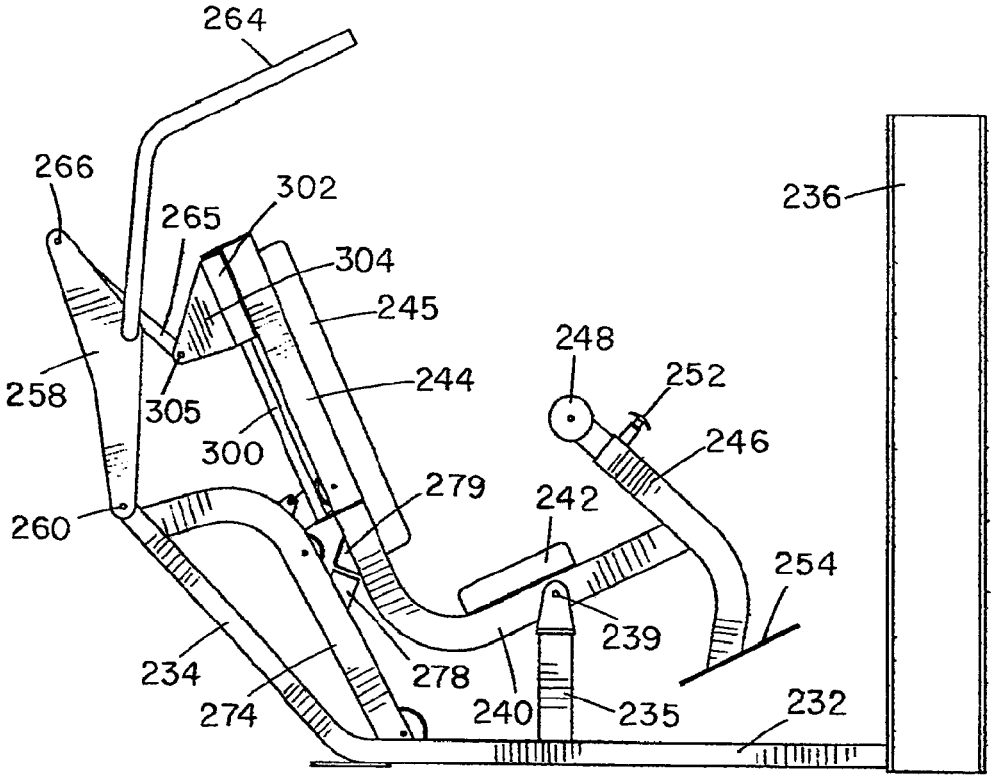
FIG. 24 is a side elevation view of a lat pull down exercise machine according to another embodiment of the invention, with the machine illustrated in a start position adopted at the start of an exercise movement.
Figure 25:
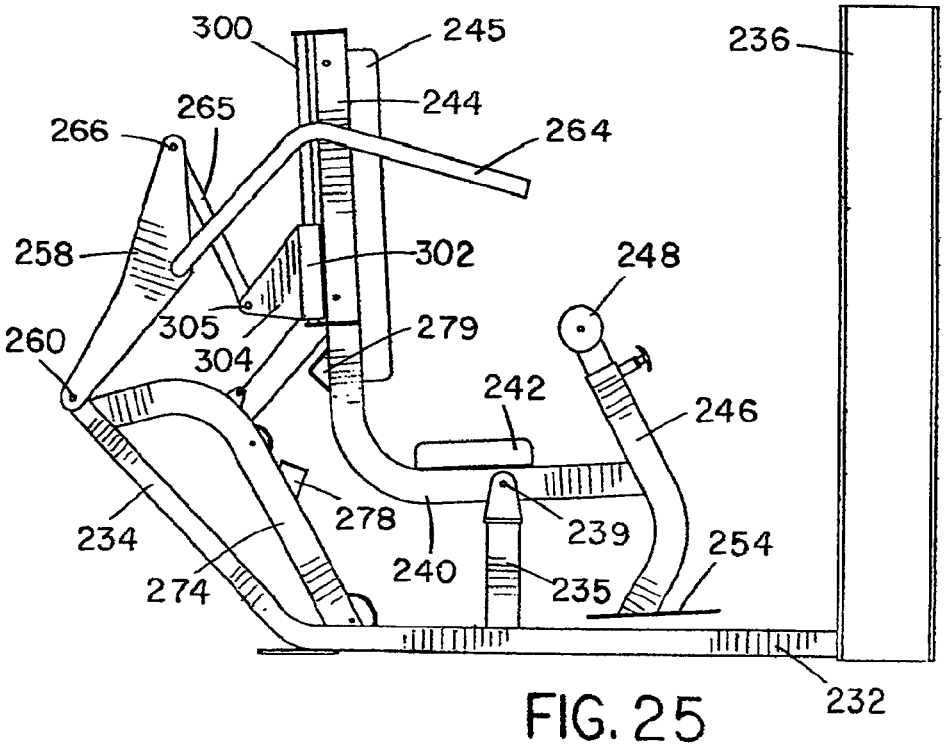
FIG. 25 is a side elevation view similar to FIG. 24, illustrating the exercise end position.

FIGS. 24 and 25 illustrate another modification of the embodiment of FIGS. 18 to 21 in which the connecting link is pivotally connected to a linear slide rather than directly to the rear upright 244 of the user support frame. This embodiment is otherwise identical to that of FIGS. 18 to 21, and like reference numerals have been used for like parts as appropriate. In this embodiment, a guide rail 300 is secured to the rear side of the user support upright 244, and a slide member 302 is slidably mounted on the guide rail 300. The connecting link 265 is pivoted at one end to the pivot brackets or plates 258 via pivot 266, as in the embodiment of FIGS. 18 to 21, but the opposite end is pivoted to a mounting bracket 304 on the slide member 302, via pivot 305.

Again, the exercise start and finish position of FIGS. 24 and 25, respectively, is identical to that of the previous embodiment. In the start position of FIG. 24, the slide member 302 is at the upper end of the guide rail or track 300. As the exercise arm is pulled down, the slide member moves down the guide bar, forcing the user support to rotate upward.

Figure 26:
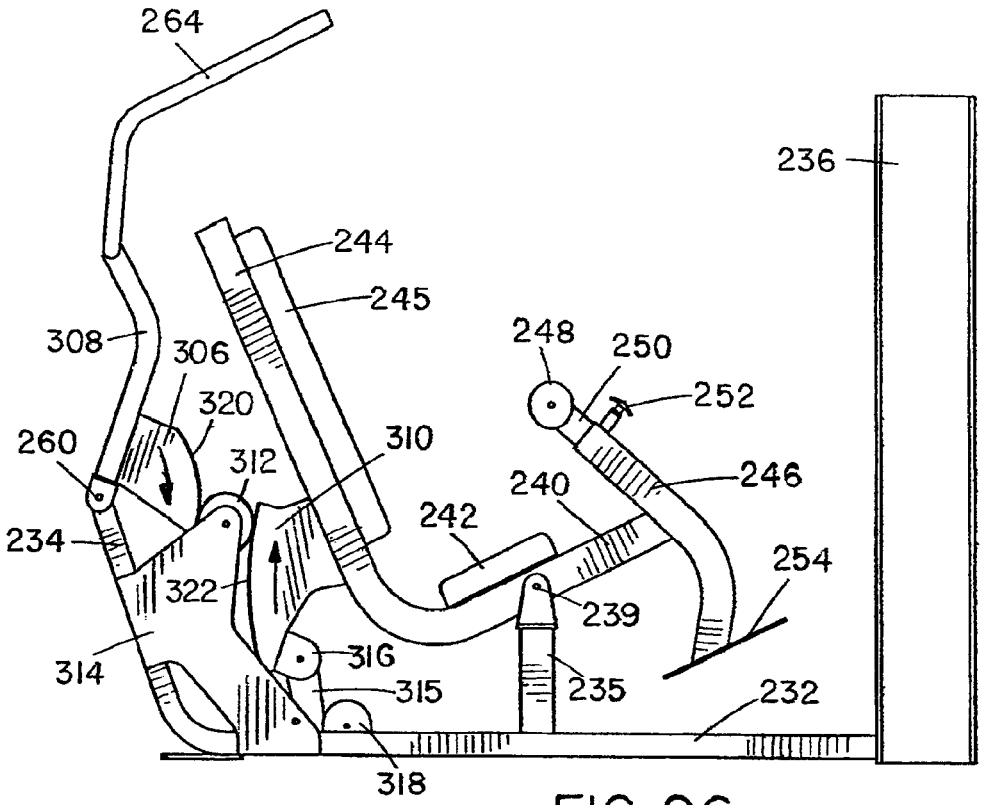
FIG. 26 is a side elevation view of a lat pull down exercise machine according to another embodiment of the invention, with the machine illustrated in a start position adopted at the start of an exercise movement.
Figure 27:
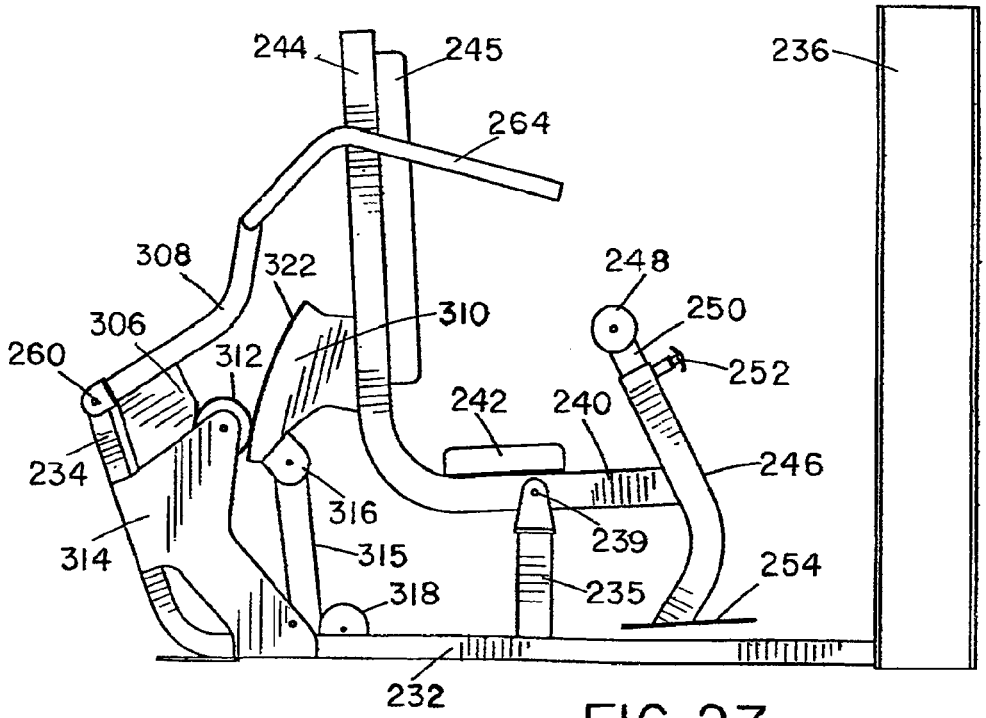
FIG. 27 is a side elevation view similar to FIG. 26, illustrating the exercise end position.

FIGS. 26 and 27 illustrate another modification of the machine of FIGS. 18 to 21, in which the pivotally mounted connecting link is replaced by geared cams to translate downward movement of the exercise arm into forward rotation of the user support. Again, the machine of FIGS. 26 and 27 is otherwise identical to that of FIGS. 18 to 21, and like reference numerals have been used for like parts as appropriate.

A first geared cam 306 with gear teeth extending along arcuate edge 320 is mounted on a rear portion 308 of the exercise arm 264, which in turn is pivoted to the upper end of the frame rear upright 234 at pivot 260. A second geared cam 310 with gear teeth extending along arcuate edge 322 is mounted on the rear of the user support upright 244. A matching geared sprocket 312 is rotatably mounted on a mounting bracket 314 secured to the main frame. Geared cam 310 is linked to the weight stack via a cable 315 which has one end linked to mounting bracket 314 and extends around a pulley 316 on geared cam 310, a pulley 318 on the frame base 232, and from there into the weight stack housing, where it will be linked to the weight stack in a conventional manner (not illustrated). The arrows in FIG. 26 illustrate the direction of rotation on each gear. Teeth on the arcuate edges 320,322 of the cams 306,310, respectively, mesh with teeth on the sprocket 312.

The exercise movement in this case will again be identical to that illustrated in FIGS. 20 to 21 above, with the same start and finish position for the user, user support frame, and exercise arm. In this case, as the exercise arm is pulled downward, its geared cam 306 rotates in a clockwise direction about the arm's pivotal connection 260 to the main frame. This causes the geared sprocket 312 to rotate in a counter-clockwise direction. This, in turn, causes the geared cam 310 on the user support to rotate clockwise in the direction of the arrow in FIG. 26, forcing the user support to rotate forward into the upright finish position of FIG. 27.

Figure 28:
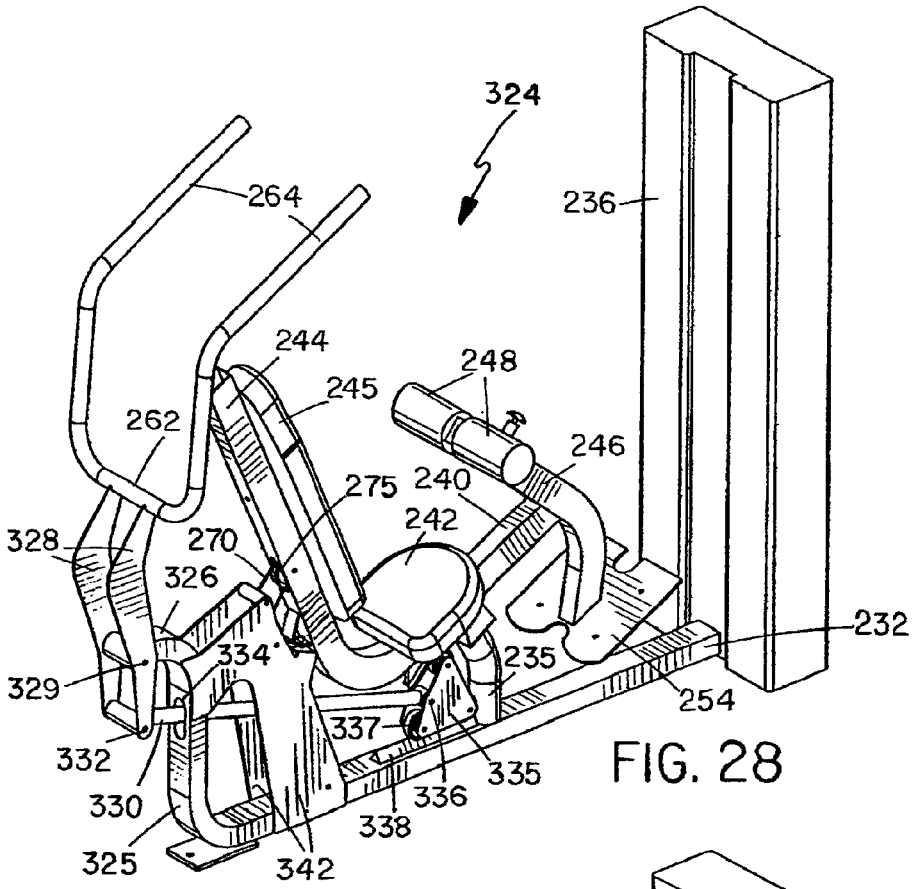
FIG. 28 is a rear perspective view of a lat pull down exercise machine according to another embodiment of the invention, with the machine illustrated in a start position adopted at the start of an exercise movement.
Figure 29:
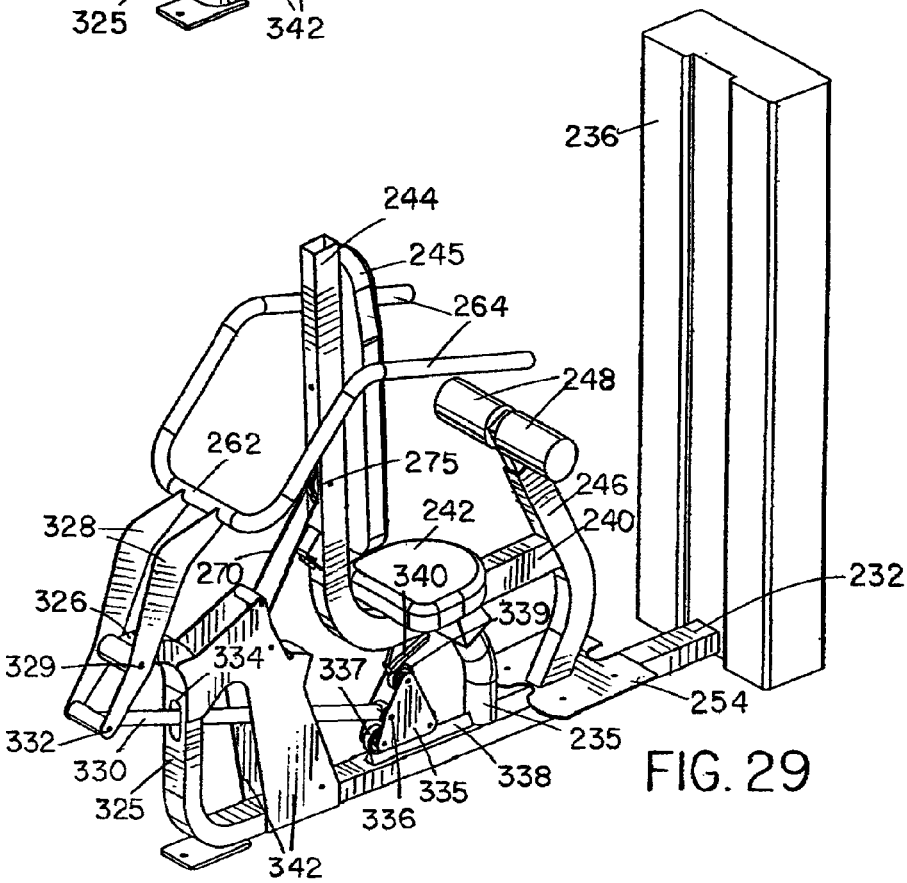
FIG. 29 is a rear perspective view similar to FIG. 28, with the machine in the exercise end position.

FIGS. 28 and 29 illustrate another modified exercise machine 324 which has a modified connecting linkage between the user support and exercise arm. The machine of FIGS. 28 and 29 is otherwise identical to that of FIGS. 18 to 21, and like reference numerals have been used for like parts as appropriate. As in the embodiments of FIGS. 22 to 27, the exercise movement is identical to that of FIGS. 18 to 21, with the user, user support, and exercise arm adopting the same positions as illustrated in FIGS. 20 and 21 in the exercise start and finish positions.

In the embodiment of FIGS. 28 and 29, the rear upright 325 of the main frame is modified in shape to have a generally vertical portion and a rearwardly curved end portion 326. The exercise arm is pivotally connected to the main frame via pivot brackets 328 extending from the central portion 262 of the arm. Brackets 328 are pivotally secured to the rear end of the frame rear upright 325 at pivot 329. A connecting link or bar 330 is pivoted at one end to the lower ends of the pivot brackets 328 via pivot 332, and extends in a forward direction through an elongate opening 334 in the rear upright 325. The forward end of the link 330 is pivoted to a rolling wedge member 335 at pivot 336. The rolling wedge member has a first pair of rollers 337 in rolling engagement with a track or guide 338 on the frame base member 232, and an upper roller 339 in rolling engagement with an inclined guide or track 340 on the undersurface of the user support base 240. This linkage is similar to that described in co-pending application Ser. No. 10/195,665 filed Jul. 12, 2002, the contents of which are incorporated herein by reference.

As in the first embodiment, the user support frame is linked to the weight stack by a cable and pulley system, but this linkage is slightly modified to provide clearance for the path of the connecting link to the sliding wedge assembly. Cable 270 extends from an anchor between mounting plates 342, around a pulley 275 on the rear of user support upright 244, and then around pulleys rotatably mounted between the plates 342 and in frame base 232 before extending into the weight stack housing to link to the weight stack in a conventional manner.

As illustrated in FIG. 28, in the start position, the rolling wedge 335 is located at the forward ends of the two guide tracks 338 and 340, and the exercise arm 256 is in the raised position above the head of a user seated on the user support seat pad with their back against back pad 245. As the exercise arm is pulled downward to the finish position of FIG. 29, the lower end of the pivot brackets 328 will pivot upwardly in a clockwise direction about pivot 329, simultaneously pulling the connecting link 330 rearwardly and upwardly. The opening 334 in the frame upright 325 is elongated to permit this motion. The connecting link 330 in turn pulls the rolling wedge 335 rearwardly along tracks 338,340, forcing the user support to rotate forward into the upright position.

The embodiments of FIGS. 24 to 29 illustrate various different possible connecting links between the exercise arm and user support, but are otherwise identical to the embodiment of FIGS. 18 to 21 and have the same general pull down exercise movement which accurately mimics a free bar chin up exercise. At the same time, each of these embodiments provides a gentle forward rocking motion of the user support while the user performs the exercise, making the exercise more fun. The user is properly supported with three separate user supports at fixed relative orientations during the exercise movement, comprising the primary support of the seat pad and back pad, the secondary support of the thigh hold down pads, and the third support of the user's feet on the foot rests which travel with the user support.

Figure 30:
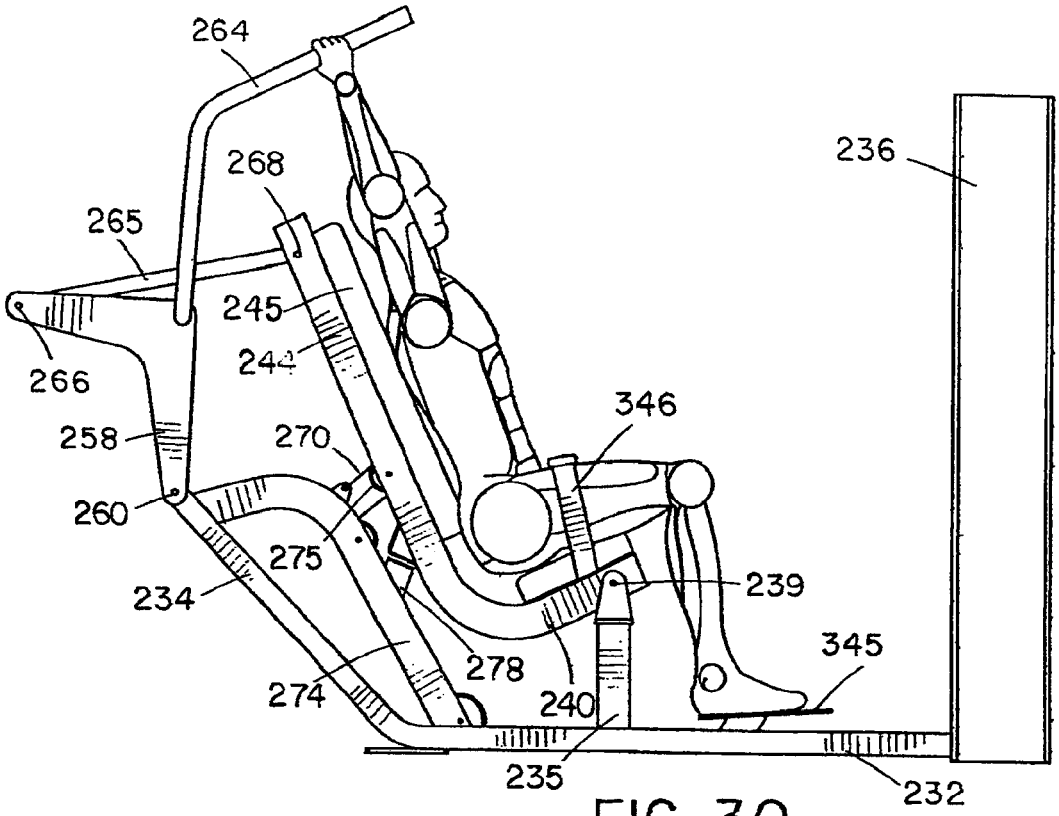
FIG. 30 is a side elevation view of a lat pull down exercise machine according to another embodiment of the invention, with the machine illustrated in a start position adopted at the start of an exercise movement.
Figure 31:
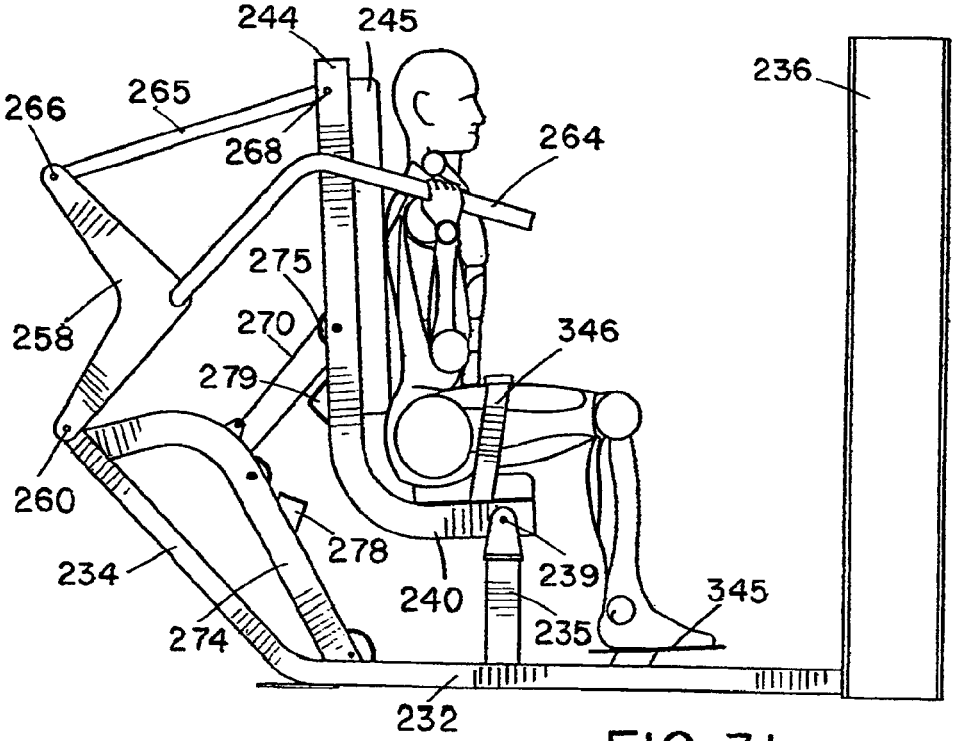
FIG. 31 is a side elevation view similar to FIG. 30, illustrating the exercise end position.

Although the previous embodiments illustrate a foot rest which travels with the user support frame, this is not essential, and FIGS. 30 and 31 illustrate another modification in which a foot rest or foot support plate 345 is mounted on the base 232 of the user support frame, rather than at the forward end of the user support frame as in the embodiments of FIGS. 18 to 29. It will be understood that the moving foot support of any of these embodiments may be replaced with the stationary foot support mounted on the main frame as in FIGS. 30 and 31. Another modification in this embodiment is the replacement of the thigh hold down pads 248 with a seat belt 346 which the user tightens over their thighs as illustrated in FIGS. 30 and 31. It will be understood that the thigh hold down pads of any of the embodiments of FIGS. 1 to 29 may be replaced by a seat belt as illustrated in FIGS. 30 and 31. The machine of FIGS. 30 and 31 is otherwise identical to that of FIGS. 18 to 21, and like reference numerals have been used for like parts as appropriate. It can be seen by comparison of the start position and stop position of FIGS. 30 and 31 with that illustrated in FIGS. 20 and 21 that the stationary foot rest is still comfortable for the user and does not detract from the self-aligning operation throughout the exercise movement.

Figure 32:
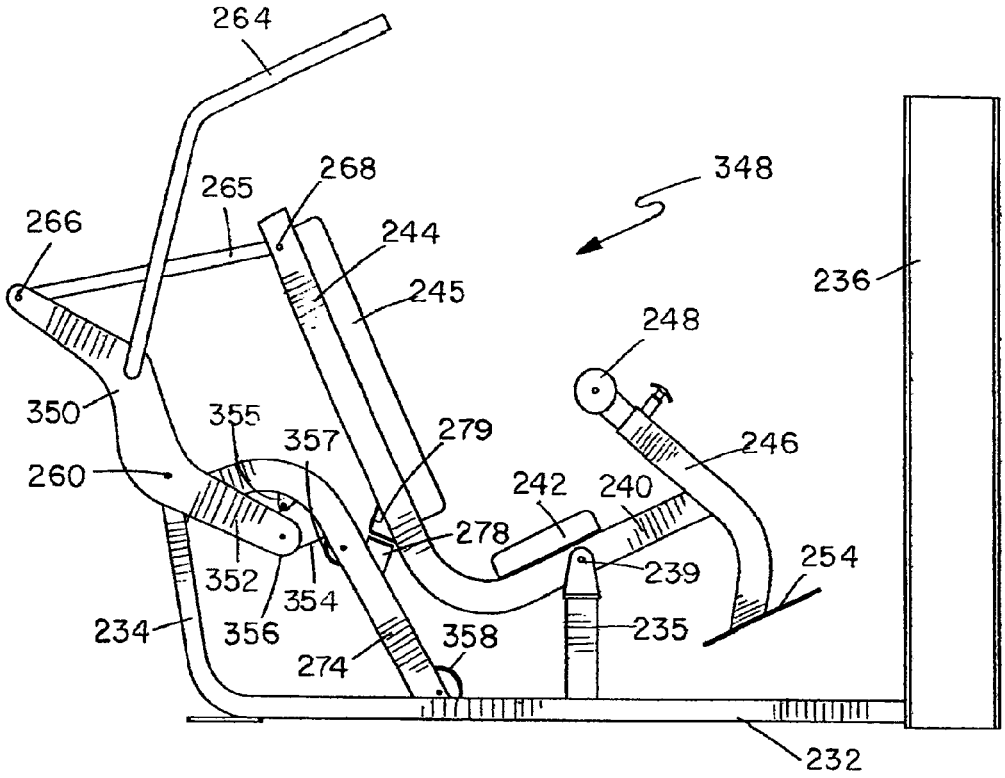
FIG. 32 is a side elevation view of a lat pull down exercise machine according to another embodiment of the invention, with the machine in the exercise start position.
Figure 33:
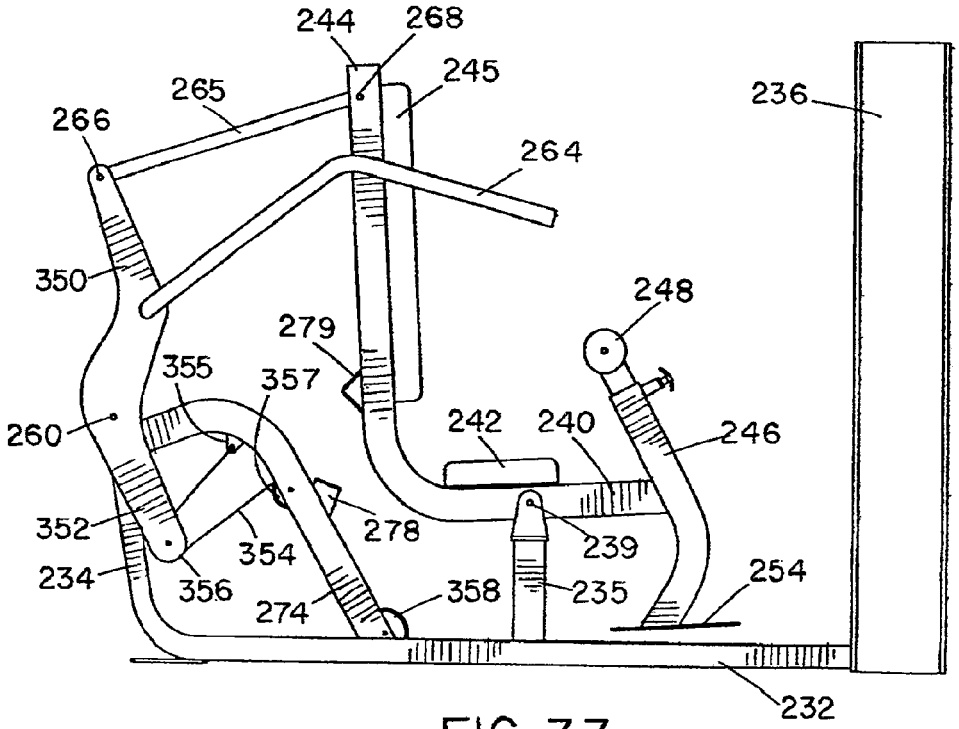
FIG. 33 is a side elevation view similar to FIG. 32, illustrating the exercise end position.

FIGS. 32 and 33 illustrate an exercise machine 348 which is similar to that of FIGS. 18 to 21 with the same linkage system but in which the exercise arm, rather than the user support, is linked to the exercise resistance (in this case a weight stack). All other parts of the machine are identical to that of FIGS. 18 to 21, and like reference numerals have been used for like parts as appropriate. In this embodiment, the V-shaped pivot brackets connected to the exercise arm in the previous embodiment are replaced with extended pivot brackets 350 which have an upper end pivoted to one end of the connecting link 265 in the same manner as the embodiment of FIGS. 18 to 21, but are pivoted to the frame upright 234 at an intermediate point in their length via pivot 260, and have a downward extension 352 from pivot 260. This downward extension is linked to the weight stack (not visible) in weight stack housing 236 via resistive cable 354 which extends from an anchor 355 on the frame strut 274, around a pulley 356 at the end of extension 352, and then around pulleys 357,358 on strut 274 before extending through the frame base and into the weight stack housing. The central portion of the exercise arm is secured to the pivot plates 350 at a location between pivots 260 and 266.

The exercise motion of the exercise arm, user support frame, and user in this embodiment is identical to that of FIGS. 18 to 21, and has the same self-aligning benefits. The linked motion of the exercise arm and user support frame is exactly the same as that of the embodiment of FIGS. 18 to 21, but the downward motion of the exercise arm forces the pivot bracket 350 to pivot in a clockwise direction about pivot 260, pulling back the lower end portion 352 of the bracket 350, and simultaneously pulling on cable 354 so as to lift the weight stack. It will be understood that any of the previous embodiments may also be modified to have the exercise resistance linked to the exercise arm rather than to the user support frame, in a similar manner.

Figure 34:
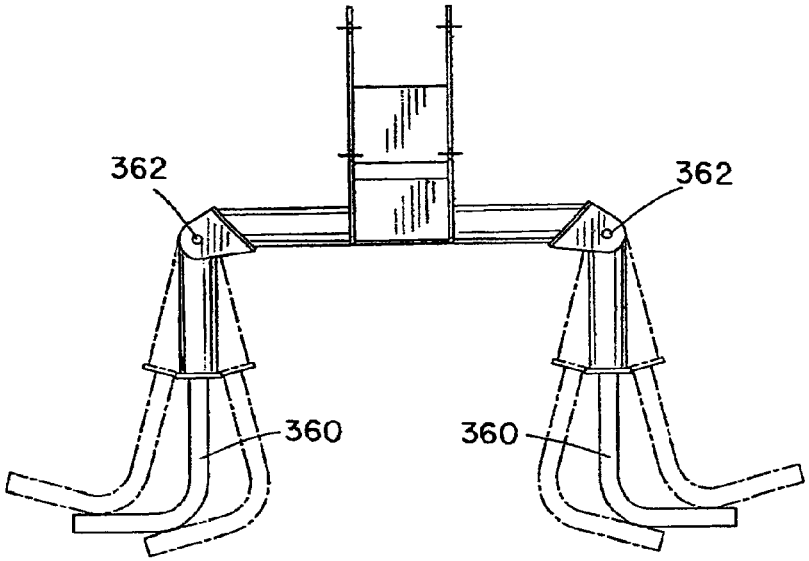
FIG. 34 is a front elevation view illustration alternative handles for use in any of the illustrated embodiments.

Each of the previous embodiments have fixed handles on the exercise arm for engagement by the user. However, any of these embodiments may be modified to provide adjustable user engaging handles. FIG. 34 illustrates one possible modified handle assembly which may be used in place of the single, U-shaped handle bar 32 in any of the embodiments of FIGS. 1 to 17, or may be attached to the ends of the fixed handle arms 264 in any of the embodiments of FIGS. 18 to 33. In this case, the user engaging handles 360 are pivotally connected to the ends of exercise arm 25 via pivots 362, and provide for inward/outward movement to provide a converging exercise motion as the arms are pulled downward, as indicated in dotted outline in FIG. 34. In another alternative, the rigid handles 360 may be replaced with flexible strap handles, attached to the rigid movement arm 25 or handle arms 264 so as to provide the user with multiple hand positions.

Figure 35:
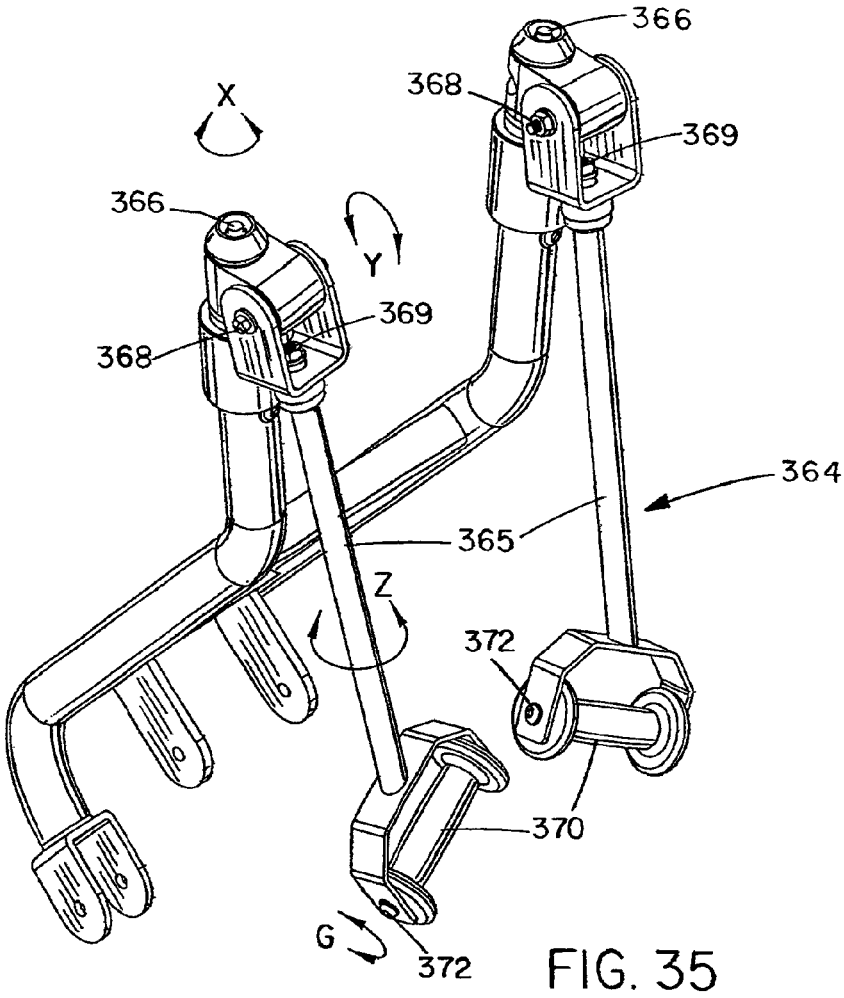
FIG. 35 is a front perspective view illustrating another alternative handle assembly.

Another option would be a handle assembly 364 as illustrated in FIG. 35, for providing three dimensional handle movement. Handle arms 365 are each pivoted to a respective end of the exercise arm (either arm 25 of FIGS. 1 to 17 or arm 264 of FIGS. 18 to 33) via a multi-directional pivot joint having three perpendicular pivot axes comprising a first pivot 366, a second pivot 368, and a third pivot 369, for rotation in X, Y and Z directions as indicated by the arrows. Hand grip 370 at the end of arm 365 is also rotatably mounted for rotation about pivot 372, as indicated by the arrow G. This arrangement allows the user to determine the inward/outward (X), forward/rearward (Y) and rotational (pronation/supination—Z) movement of their hands. It allows the user to perform a converging exercise movement as well as performing wide, narrow, or neutral grip exercises.

Each of the embodiments of FIGS. 1 to 33 has a pivoting or rocking user support that continuously and automatically self-aligns to the movement of the exercise arm throughout the entire exercise motion, thereby maintaining an ideal alignment relationship between the exerciser positioned on the user support and the user engaging means or handles on the exercise arm. This design provides the proper starting and finishing alignment between the user and machine for an exercise which simulates a free bar, chin up exercise. The combined motion of the user support and exercise arm replicates the natural, rearward arcing motion of the human body when performing a traditional chin up exercise. This combined motion of the user support and exercise arm also provides a safer and more natural feeling exercise motion. It is an improvement over the improper linear motion and exaggerated arcing movement of prior art rigid arm lat pull down machines. By placing the user support pivot under the user and having a balanced portion of the user and user support on both sides of the gravitational center line of the pivot throughout the exercise motion, the weight of the user and user support has little effect on the resistance. This helps to reduce the initial lift or starting resistance, and also prevents or reduces resistance drop off at the end of an exercise.

Each of the above rigid arm pull down machines places the user in a start position with their arms extending straight overhead, in line with the side centerline of the user's body, and ends with the user's hands below their chin and slightly in front of their shoulders. This is essentially the same as the start and finish position of a free bar chin up machine, and involves no risk of the user's head hitting the handle bar during the exercise movement, due to the simultaneous adjustment of the user seat position. The user is properly braced with a secondary support, such as thigh hold down pads or straps, with or without a back support, during the exercise, and does not have to adjust their body position or tuck their head to miss a single piece handle bar, as in some prior art machines. The machines all have user supports which are low to the ground and easily accessible for mounting and dismounting, and do not require the user to climb onto a vertically moving platform or up and down steps in order to reach a user support.

In each of the machines described above, the handle portions of the exercise arms automatically produce the correct starting and finishing arm and hand positions for the user, because the user support adjusts to the exercise arm position. Movement of the user support is dependent on and linked to movement of the user engagement means or exercise arm. The primary and secondary user supports (user support seat and user support thigh hold-down pads or straps) are in fixed alignment to each other and travel together through the same range of motion, and rotate together about a fixed pivot.

The different embodiments described and illustrated above together provide all the starting hand positions used in traditional free bar chin up exercises, such as wide and close grip overlapped, reverse close grip, and neutral grip. For example, different hand grip positions are provided in the embodiment of FIGS. 1 to 6 (see FIGS. 5 and 6) and FIGS. 18 to 21 (see FIGS. 20 and 21). The modified handle assemblies of FIGS. 34 and 35 also provide multiple different hand grip positions for any of the embodiments described above.

Another advantage of positioning the user support pivot beneath the user so that the combined weight of the user and user support is positioned on opposite sides of the gravitational centerline of the pivot is that it reduces or eliminates the amount of counter-balancing weight required to offset the weight of the exercise arm assembly when starting the exercise. In the embodiments of FIGS. 18 to 33, no additional counterweight is needed, while the embodiments of FIGS. 1 to 17 require only a small additional counterweight. This counterweight is positioned close to the exercise arm pivot, above the framework of the machine and out of harm's way. The counterweight has a travel path which is blocked against intrusion by the weight stack housing, increasing safety and reducing the risk of injury, which is not true of much of the prior art which requires counterweights projecting out to the rear of the user support.

It should be understood that the different elements used in the various embodiments described above may be mixed and interchanged. Any of the above linkages between the user support and exercise arm may be used in any of the designs described above. The foot rest could be stationary or move with the user support. User support pads (seat pad, back pad, and thigh hold down pads or straps) may be fixed or adjustable. The exercise arms may be one piece (dependent) or two piece (independent), and may be unidirectional or bidirectional. The connecting links may be adjustable in length, solid links may be replaced with flexible links, and the links may be arranged either to push or pull in order to force rotation of the user support. Different handles may be used without affecting the operation of the machine. The cable and pulley system linked to a weight stack may be replaced with weight plates mounted on pegs, as in FIGS. 16 and 17 or 22 and 23. Other types of resistance known in the art, such as hydraulic, pneumatic, or electromagnetic resistance, or elastic bands, may be used in place of the weight stack or weight plates. Cable linkages could be replaced by belts, ropes, chains, or the like, and pulleys may be replaced by sprockets. Any of the various designs could have the resistance associated with any of the moving parts of the machine, i.e. the user support, exercise arm, or connecting link.

In summary, the rigid arm lat pull down machine of this invention provides an exercise simulating a free bar chin up exercise which is fun, more comfortable, and safe to use. By forcing the user support to move in a self-aligning motion with the exercise arm, the exaggerated and unnatural arcing movement found in prior art lat pull down machines is avoided, and replaced with a smaller, natural arc similar to that an exerciser would encounter when performing chin ups or pull ups on a free bar. The reclined seat places the user in a proper starting position and the secondary support (thigh hold down or thigh hold down plus back pad) makes sure to keep the user in a safe, stable position throughout the exercise. At the same time, the rocking motion of the user support makes the exercise more fin to perform. By adding motion to the user support, performing the exercise is more enjoyable and the user's interest in the workout will increase. This may help to convince the user to exercise more regularly.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An exercise machine, comprising:

a main frame having a user support pivot mount, a forward end, and a rear end;

a user support frame pivotally mounted on the user support pivot mount for supporting a user in a seated position facing the forward end of the main frame, the user support frame having a forward end and a rear end and comprising a primary user support which supports a first part of a user's body and a secondary user support, the primary user support supporting the majority of a user's weight at least in a start position for an exercise, and the secondary user support traveling with the primary user support and not moving relative to the primary user support during an exercise;

the user support pivot mount controlling pivotal movement of the user support frame in a predetermined exercise movement path about a user support pivot axis from an exercise start position to an exercise end position;

a user engagement device movably mounted on one of the frames and adapted for engagement and movement by a user when performing an exercise between a start position and an end position lower than the start position, the user engagement device having a user engaging portion which is located closer to the forward end of the user support frame in the end position than in the start position;

a movable linkage which translates movement of the user engagement device to movement of the user support frame, whereby the user support frame pivots in the exercise movement path from the exercise start position as the user engagement device is moved from the start position; and a load separate from the user which resists movement of at least one of the moving parts of the machine;

the combined motion of the user support frame and user engagement device during an exercise substantially replicating the natural movement of the upper part of the human body when performing a free bar chin up exercise.

2. The machine as claimed in claim 1, wherein the exercise start position of the user support frame comprises an inclined position.

3. The machine as claimed in claim 2, wherein the exercise end position of the user support frame is an inclined position at a different angle of inclination to the start position.

4. The machine as claimed in claim 1, wherein the user engagement device is moveably mounted on the frame for rotation about an exercise arm pivot.

5. The machine as claimed in claim 4, wherein the exercise arm pivot is positioned forward of the user support.

6. The machine as claimed in claim 1, wherein a gravitational centerline extending vertically through said user support pivot axis extends through the primary user support as the user support frame moves along at least part of said predetermined exercise movement path and only a portion of the user support frame passes through the gravitational centerline during the exercise movement.

7. The machine as claimed in claim 1, wherein the secondary user support comprises a thigh hold down device.

8. The machine as claimed in claim 7, wherein the thigh hold down device comprises pads adapted to engage the thighs of a user seated on the user support frame.

9. The machine as claimed in claim 7, including an additional user support for supporting a different part of the user's body from the primary user support and secondary user support.

10. The machine as claimed in claim 9, wherein the additional user support is mounted on the user support frame and moves in fixed relationship with the primary and secondary user supports.

11. The machine as claimed in claim 9, wherein the additional user support comprises a foot support for the user's feet.

12. The machine as claimed in claim 7, wherein the user support frame has a base and an upright, the primary user support being mounted on the base.

13. The machine as claimed in claim 1, wherein the user support frame defines an initial position for the user's body when supported on the frame in the start position of the exercise, and a finish position for the user's body in the end position of the exercise, the pivotal movement of the user support defining a gravitational centerline extending through the user's body in at least one of said user positions.

14. The machine as claimed in claim 1, wherein the main frame has a base and the user support pivot mount is associated with the base.

15. The machine as claimed in claim 1, wherein the user engagement device is movably mounted on the main frame.

16. The machine as claimed in claim 1, wherein the user engagement device comprises at least one rigid exercise arm.

17. The machine as claimed in claim 1, wherein the user engagement device comprises a pair of independently movable exercise arms.

18. The machine as claimed in claim 1, wherein the load comprises a selectorized weight stack.

19. The machine as claimed in claim 1, wherein the load is linked to said user support frame.

20. The machine as claimed in claim 1, wherein the main frame has a base, the user support pivot mount being located on said base, and an upright strut spaced forward of said pivot mount and having an upper end, the user engagement device comprising an exercise arm pivotally mounted approximate said upper end of said upright strut for rotation about an exercise arm pivot axis and having a first portion extending from said exercise arm pivot axis towards the forward end of said frame and a second portion extending towards the rear end of said frame, and user engaging handles depending downwardly from said second portion above said user support frame for engagement by a user.

21. The machine as claimed in claim 20, further comprising a counterweight associated with the first portion of said exercise arm.

22. The machine as claimed in claim 21, wherein said load comprises a weight stack, said frame having a weight stack housing containing said weight stack and extending upwardly at the forward end of said frame, said counterweight being located above said weight stack housing.

23. The machine as claimed in claim 1, wherein said connecting linkage comprises a cable and pulley assembly between said exercise arm and said user support frame.

24. A lat pull down exercise machine for performing an exercise equivalent to a free bar chin up exercise, comprising:

a main frame having a first end and a second end;

a user support frame adapted to support a user in an exercise ready position facing the first end of the main frame, the user support frame being pivotally mounted on the main frame for rotation about a user support pivot axis in a predetermined pivotal movement path from an exercise start position to an exercise end position, the user support frame comprising one moving part of the machine;

the user support frame comprising a primary user support which supports the majority of a user's weight at least in a start position for an exercise, and a secondary user support, the secondary user support traveling with the primary user support and not moving relative to the primary user support as the user support frame moves in said pivotal movement path during an exercise;

an exercise arm which is adapted to be used in performing only one type of exercise, the exercise arm being movably mounted on one of the frames for engagement and movement by the user in a first direction in performing exercises, the exercise arm having a user engaging portion, and comprising a second moving part of the machine;

a connecting linkage movably engaged with at least two of the main frame, user support frame and exercise arm for linking movement of the exercise arm to movement of the user support frame, whereby movement of the exercise arm from a start position to an end position during an exercise simultaneously rotates the user support frame from the exercise start position to the exercise end position, the connecting linkage comprising a third moving part of the machine; and a load which resists movement of at least one of the moving parts of the machine only when the exercise arm is moved in said first direction, whereby the exercise arm is unidirectional;

the combined motion of the user support frame and user engagement arm between the start and end position substantially replicating the natural movement of the upper part of the human body when performing a free bar chin up exercise.

25. The machine as claimed in claim 24, wherein the user support pivot axis is positioned at a predetermined location under the user support frame and a gravitational centerline extending vertically through the user support pivot axis extends through one of the user supports during at least part of the movement of the user support frame along said predetermined pivotal movement path, and only a portion of the user support frame passes through the gravitational centerline during the exercise movement.

26. The machine as claimed in claim 24, wherein the user support frame is in an inclined orientation in the exercise start position.

27. The machine as claimed in claim 26, wherein the user support frame is in an inclined orientation at a different angle to the exercise start position in the exercise end position.

28. The machine as claimed in claim 24, wherein the exercise arm is movably mounted on the main frame.

29. The machine as claimed in claim 28, wherein the exercise arm is pivotally mounted on the main frame.

30. The machine as claimed in claim 29, wherein the exercise arm is pivotally mounted on the main frame for rotation about an exercise arm pivot axis at a location spaced above the user support frame.

31. The machine as claimed in claim 30, wherein the exercise arm pivot axis is spaced closer to the first end of the main frame than the user support pivot mount.

32. The machine as claimed in claim 1, wherein the load is adjustable to vary the exercise resistance.

33. The machine as claimed in claim 1, wherein the user engagement device is unidirectional and the load resists movement of at least one of the moving parts of the machine only when the user engagement device is moved in one direction between the start and end positions.

34. The machine as claimed in claim 1, wherein the secondary user support is spaced away from the primary user support and supports a different part of the user's body from the primary user support, and is secured at a fixed angular orientation relative to the primary user support throughout an exercise, whereby the primary and secondary user support travel together in the same relative orientation to one another throughout the exercise.

35. The machine as claimed in claim 24, wherein the primary user support has a first end closest to the first end of the main frame, the exercise arm and user support frame are positioned relative to one another in the start position of the exercise arm such that the user engaging portion is located in a first position above the primary user support and the user engaging portion is located in a second position spaced below the first position and closer to the first end of the primary user support than the first position in the end position of the exercise arm, whereby a user seated on the primary user support in an exercise ready position with the user support frame in an exercise start position can engage the user engaging portion with their arms extending straight above their head and in line with the side centerline of their body and move the user engaging portion down and towards the first end of the primary user support into the second position in front of their body at the end of an exercise.

* * * * *